US008851949B2

(12) United States Patent
Grutta et al.

(10) Patent No.: US 8,851,949 B2
(45) Date of Patent: Oct. 7, 2014

(54) SYSTEMS AND METHODS FOR INFLATABLE AVALANCHE PROTECTION WITH ACTIVE DEFLATION

(75) Inventors: James Thomas Grutta, Draper, UT (US); Nathan Kuder, Park City, UT (US); Peter Thomas Gompet, Huntsville, UT (US); Derick J. Neffsinger, Salt Lake City, UT (US); Robert John Horacek, Park City, UT (US); Joseph Benjamin Walker, Draper, UT (US); David Kuhlmann Blackwell, Highland, UT (US)

(73) Assignee: Black Diamond Equipment, Ltd, Salt Lake City, UT (US)

( * ) Notice: Subject to any disclaimer, the term of this patent is extended or adjusted under 35 U.S.C. 154(b) by 139 days.

(21) Appl. No.: 13/598,561

(22) Filed: Aug. 29, 2012

(65) Prior Publication Data

US 2013/0145529 A1 Jun. 13, 2013

Related U.S. Application Data

(63) Continuation-in-part of application No. 13/324,840, filed on Dec. 13, 2011.

(51) Int. Cl.
*B63C 9/00* (2006.01)

(52) U.S. Cl.
USPC ..... 441/80; 116/210

(58) Field of Classification Search
USPC ..... 441/80, 89, 90, 91, 92, 93; 116/209, 116/210
See application file for complete search history.

(56) References Cited

U.S. PATENT DOCUMENTS

| | | | | |
|---|---|---|---|---|
| 4,635,754 | A * | 1/1987 | Aschauer et al. | 441/93 |
| 4,920,674 | A * | 5/1990 | Shaeffer | 116/210 |
| 6,158,380 | A * | 12/2000 | Aschauer et al. | 116/210 |
| 6,220,909 | B1 * | 4/2001 | Aschauer et al. | 441/80 |
| 8,123,581 | B2 * | 2/2012 | Aschauer | 441/80 |
| 8,135,510 | B2 * | 3/2012 | Nakamura | 701/32.2 |

* cited by examiner

*Primary Examiner* — Lars A Olson
(74) *Attorney, Agent, or Firm* — Trent Baker; Baker & Associates PLLC

(57) ABSTRACT

One embodiment of the present invention relates to an avalanche safety system including an inflatable chamber, activation system, inflation system, and a harness. The inflatable chamber is a three-dimensionally, partially enclosed region having an inflated state and a compressed state. The inflated state may form a particular three dimensional shape configured to protect the user from impact and/or provide inverse segregation during an avalanche. The activation system is configured to receive a user-triggered action to activate the system. The inflation system is configured to transmit gas into and out of the inflatable chamber to transition between the inflated state and compressed state. The inflation system may automatically deflate or transmit the gas from the inflatable chamber external of the system. Automatic deflation of the inflatable chamber may be via a valve corresponding to a particular value such as time or three dimensional position of the user.

25 Claims, 15 Drawing Sheets

SYSTEMS AND METHODS FOR INFLATABLE AVALANCHE PROTECTION WITH ACTIVE DEFLATION

RELATED APPLICATIONS

This is a continuation-in-part of application Ser. No. 13/324,840 filed on Dec. 13, 2011, and titled "SYSTEMS AND METHODS FOR INFLATABLE AVALANCHE PROTECTION". Priority is hereby claimed to all material disclosed in this pending parent case.

FIELD OF THE INVENTION

The invention generally relates to inflatable avalanche safety systems and methods of operation. In particular, the present invention relates to systems and methods for efficient inflation of an avalanche safety chamber.

BACKGROUND OF THE INVENTION

One type of emergency life-preserving equipment is an inflatable safety system configured to inflate a chamber in response to an emergency event such as an impact or a potential impact. For example, automobile driver inflatable safety systems are designed to automatically inflate a chamber over the steering wheel in response to an impact between the automobile and another object so as to protect the driver from forceful impact with interior structures of the automobile. Likewise, avalanche inflatable safety systems are designed to manually inflate a chamber adjacent to the user in response to the user's triggering of an inflation mechanism. Inflatable safety systems generally include an inflatable chamber, an activation system, and an inflation system. The inflatable chamber is designed to expand from a compressed state to an inflated state so as to cushion the user or dampen potential impact. The inflatable chamber may also be used to encourage the user to elevate over a particular surface. The elevation of the inflatable chamber is achieved by the concept of inverse segregation, in which larger volume particles are sorted towards the top of a suspension of various sized particles in motion. The activation system enables manual or automatic activation of the inflation system. The inflation system transmits a fluid such as a gas into the inflatable chamber, thus increasing the internal pressure within the inflatable chamber and thereby transitioning the inflatable chamber from the compressed state to the inflated state.

Unfortunately, conventional inflatable avalanche safety systems fail to provide an efficient deflation procedure of the inflatable chamber. In various situations, it is necessary to deflate the inflatable chamber for both user safety and efficient operation. For example, if the system is mistakenly deployed or a burial has been avoided, the inflatable chamber should be deflated to allow the user to resume activity and/or evacuation. Likewise, if the user is buried, deflating the inflatable chamber will provide the user with more room to move and thereby potentially be more easily extricated from the snow. Conventional inflatable safety systems utilize various selective manual deflation configurations of the internal chamber. Selective manual deflation configurations may include one or more openings or channels to the internal region of the inflatable chamber, which must be manually opened by the user to cause deflation. Selective manual deflation configurations therefore require the user to perform some form of manual operation to deflate the inflatable chamber, which may not be possible in a limited mobility burial scenario.

Therefore, there is a need in the industry for an efficient and reliable inflatable avalanche safety system that overcomes the problems with conventional systems.

SUMMARY OF THE INVENTION

The present invention generally relates to inflatable avalanche safety systems and methods of operation. One embodiment of the present invention relates to an avalanche safety system including an inflatable chamber, activation system, inflation system, and a harness. The inflatable chamber is a three-dimensionally, partially enclosed region having an inflated state and a compressed state. The inflated state may form a particular three dimensional shape configured to protect the user from impact and/or provide inverse segregation during an avalanche. The activation system is configured to receive a user-triggered action to activate the system. The inflation system may include an air intake, battery, fan, and internal airway channel. Alternatively, the inflation system may include an air intake, compressed gas, and internal airway channel. The inflation system is configured to transmit gas into and out of the inflatable chamber to transition between the inflated state and compressed state. The harness may be a backpack that enables a user to transport the system while engaging in activities during which they may be exposed to avalanche risk. The harness may include hip straps, shoulder straps, internal compartments, etc. The inflation system may automatically deflate or transmit the gas from the inflatable chamber external of the system. Automatic deflation of the inflatable chamber may be via a valve corresponding to a particular value such as time or three dimensional position of the user.

Embodiments of the present invention overcome the problematic deflation procedure of conventional avalanche safety systems by including an automatic deflation mechanism configured to automatically transmit air out from the inflation chamber, rather than requiring a user to manually perform an action to initiate deflation. Embodiments of the present invention may also include a novel inflation system that enables inflation and automatic deflation of the inflatable chamber.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

The present invention generally relates to inflatable avalanche safety systems and methods of operation. One embodiment of the present invention relates to an avalanche safety system including an inflatable chamber, activation system, inflation system, and a harness. The inflatable chamber is a three-dimensionally, partially enclosed region having an inflated state and a compressed state. The inflated state may form a particular three dimensional shape configured to protect the user from impact and/or provide inverse segregation during an avalanche. The activation system is configured to receive a user-triggered action to activate the system. The inflation system may include an air intake, battery, fan, and internal airway channel. Alternatively, the inflation system may include an air intake, compressed gas, and internal airway channel. The inflation system is configured to transmit gas into and out of the inflatable chamber to transition between the inflated state and compressed state. The harness may be a backpack that enables a user to transport the system while engaging in activities during which they may be exposed to avalanche risk. The harness may include hip straps, shoulder straps, internal compartments, etc. The inflation system may automatically deflate or transmit the gas from the inflatable chamber external of the system. Automatic deflation of the inflatable chamber may be via a valve corresponding to a particular value such as time or three dimensional position of the user. Also, while embodiments are described in reference to an avalanche safety system, it will be appreciated that the teachings of the present invention are applicable to other areas including but not limited to non-avalanche impact safety systems.

Figure 1:
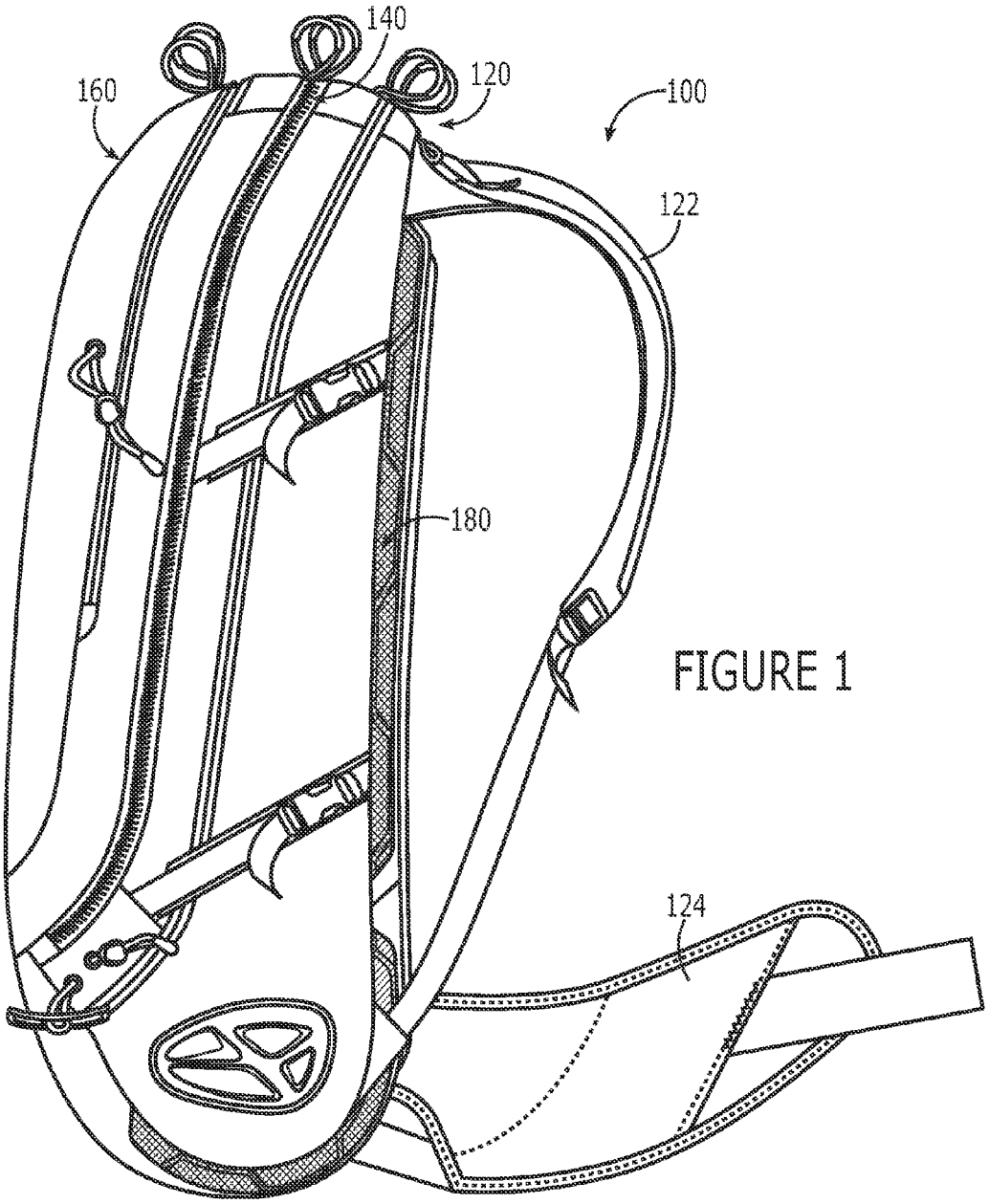
FIG. 1 illustrates a profile view of an avalanche safety system in accordance with embodiments of the present invention.

Reference is initially made to FIG. 1, which illustrates a profile view of an avalanche safety system, designated generally at 100. The illustrated system 100 includes an inflatable chamber 140, an inflation system 160, an activation system (not shown), and a harness 120. The inflatable chamber 140 is a three dimensional, inflatable, partially enclosed structure. In particular, the inflatable chamber 140 includes an inlet (not shown) and a particular inflated shape. The inflatable chamber 140 is illustrated in the compressed state in FIG. 1. The compressed state includes substantially expelling air from within the inflatable chamber and compressing the external surface of the inflatable chamber upon itself. FIG. 7C illustrates the inflated state of the inflatable chamber. The inflated state of the inflatable chamber includes expansion of the external surface away from its compressed state, substantially analogous to the inflation of a balloon. However, the inflatable chamber may include a particular three dimensional inflated shape such that upon inflation, the external surfaces are forced to form the shape. For example, the inflatable chamber may be configured to include multiple chambers, multiple regions, etc. FIG. 7C illustrates one embodiment of an inflated shape, including a substantially pillow-shaped form with two horn members. It will be appreciated that various other shapes may be practiced in accordance with embodiments of the present invention. For example, the inflatable chamber 140 may be configured to wrap around the head and/or torso of the user.

Figure 2:
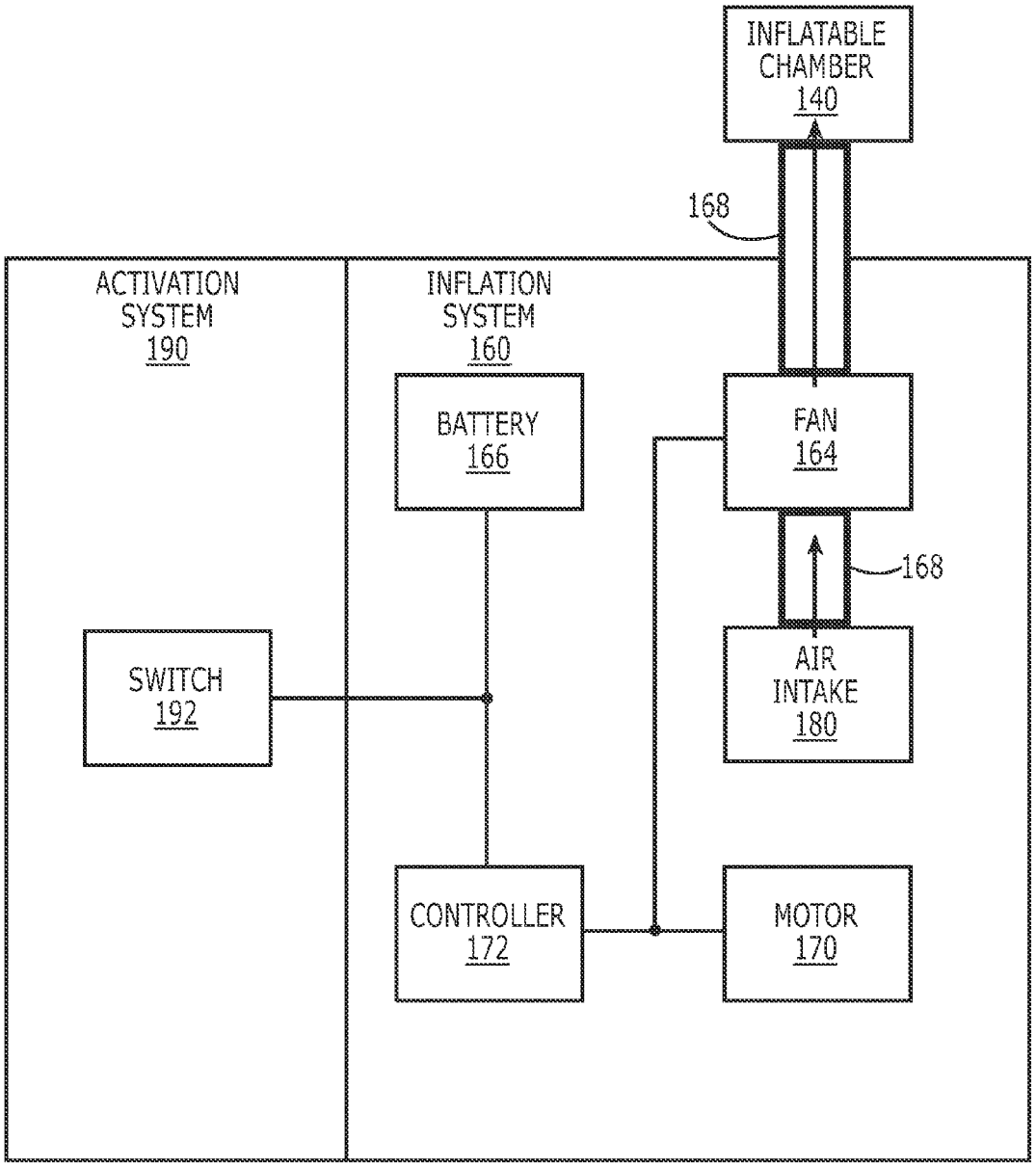
FIG. 2 illustrates a schematic of the avalanche safety system illustrated in FIG. 1.
Figure 3A:
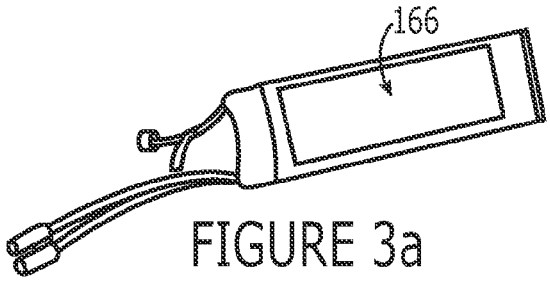
FIGS. 3*a-d* illustrates perspective views of inflation system components.
Figure 3B:
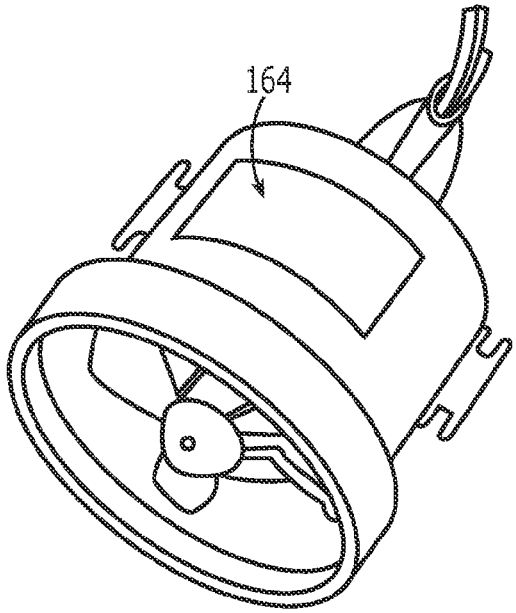
Figure 3C:
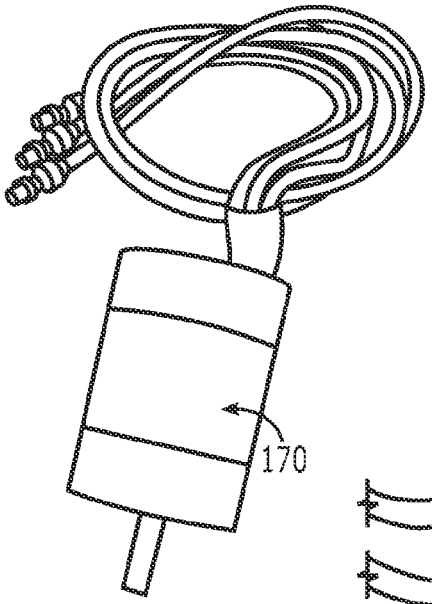
Figure 3D:
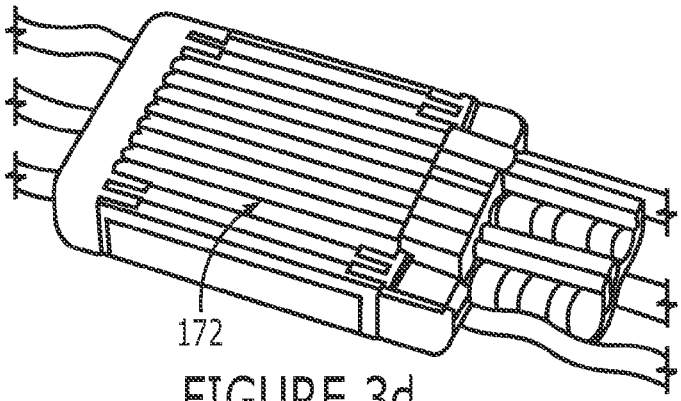

The inflation system 160 is configured to transition the inflatable chamber 140 from the compressed state to the inflated state. The inflation system 160 may further include an air intake 180, a fan 164, a battery 166, an internal airway channel 168, a motor 170, and a controller 172. The air intake 180 provides an inlet for receiving ambient air. The illustrated air intake 180 includes an elongated vent structure through which ambient air may flow. The air intake 180 is coupled to the internal airway channel 168 such that ambient air may be transmitted through the air intake 180 to the internal airway channel with minimal loss. The components and operation of the air intake will be described in more detail with reference to FIG. 5 below. The fan 164, battery 166, motor 170, and controller 172 are the electrical components of the inflation system. The electrical components of the inflation system 160 are electrically coupled to the activation system as illustrated in FIG. 2. The fan 164 is a rotational member configured to generate a vacuum force in a particular orientation upon rotation. The fan is oriented in the system 100 to generate the vacuum force such that ambient air is pulled into the inflatable chamber 140. It will be appreciated that fans in a variety of sizes may be used in accordance with embodiments of the present invention. The battery 166 may be any form of electrical storage device. The motor 170 converts electrical energy into mechanical rotation. The controller 172 may be any form of speed controller to facilitate particular inflation patterns, such as a logarithmic increase in fan speed. The fan 164, battery 166, motor 170, and controller 172 are selected to correspond with one another to facilitate optimal inflation characteristics. For example, the size of fan 164 dictates the necessary speed and time required to inflate the inflatable chamber 140. The speed and time parameters thereby influence optimal selection of the remaining electrical components.

The activation system 190 is configured to activate the inflation system 160 to expand the inflatable chamber 140 to the inflated state. The activation system 190 is a user-input device configured to a user-triggered action intended to activate the system 100. The particular user-triggered action depends on the specific type of activation system components. For example, the activation system 190 may include some form of physical switch configured to receive a physical switching motion from the user to activate the system 100. The switch may be any type of switching mechanism including but not limited to a rip cord, push button, toggle, etc. The activation system 190 is electrically coupled to the inflation system 160 so as to engage the inflation system upon receipt of the user-triggered action. Alternatively or in addition, the activation system 190 may include other sensors designed to activate the system without a user-triggered action. In addition, the activation may include a deactivation switch. The deactivation switch may be used to deactivate the system in the event of an inadvertent activation.

Figure 6:
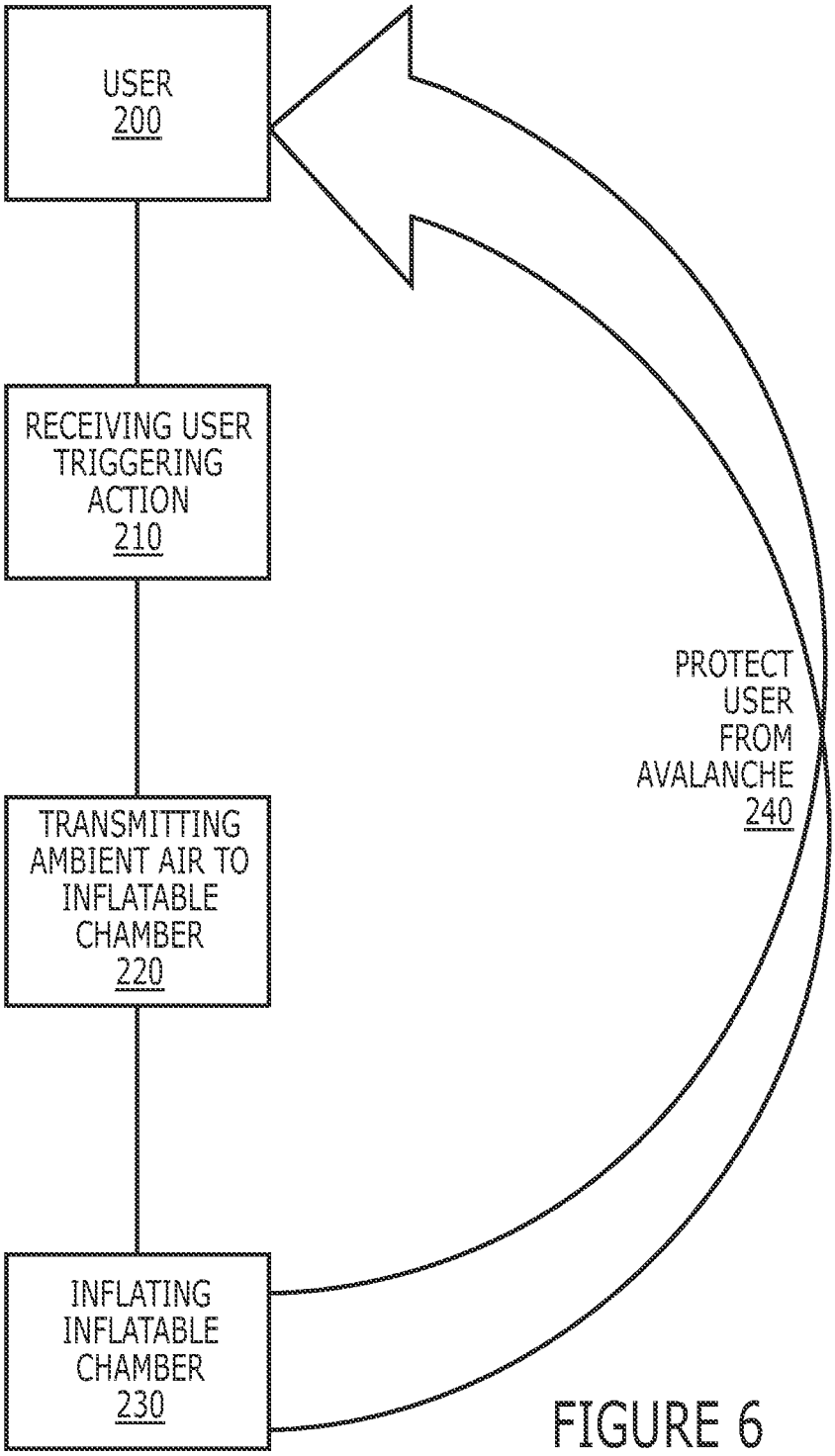
FIG. 6 illustrates a flow chart of a method in accordance with another embodiment of the present invention.
Figure 7A:
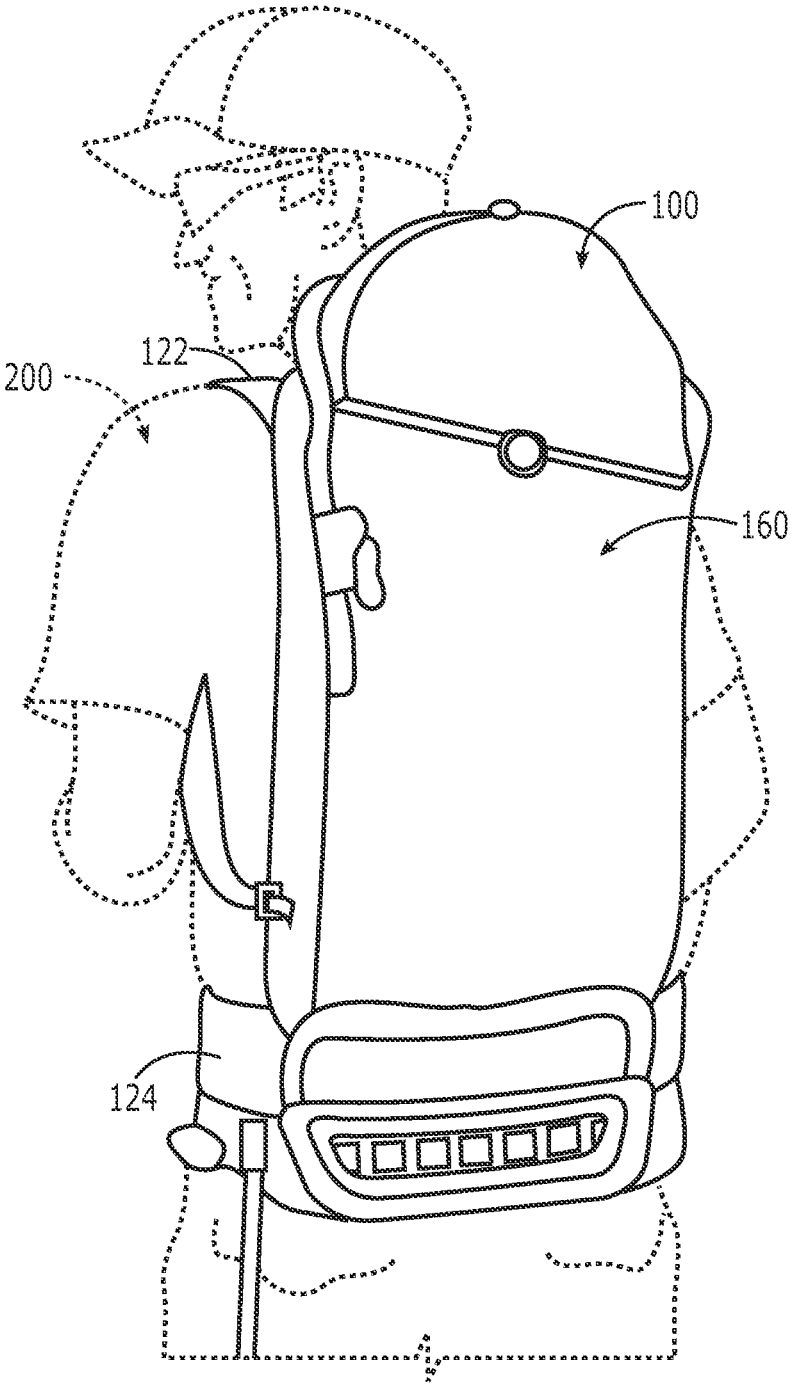
FIGS. 7A-7C illustrate an operational sequence of the system in FIG. 1 and the method of FIG. 6.
Figure 7B:
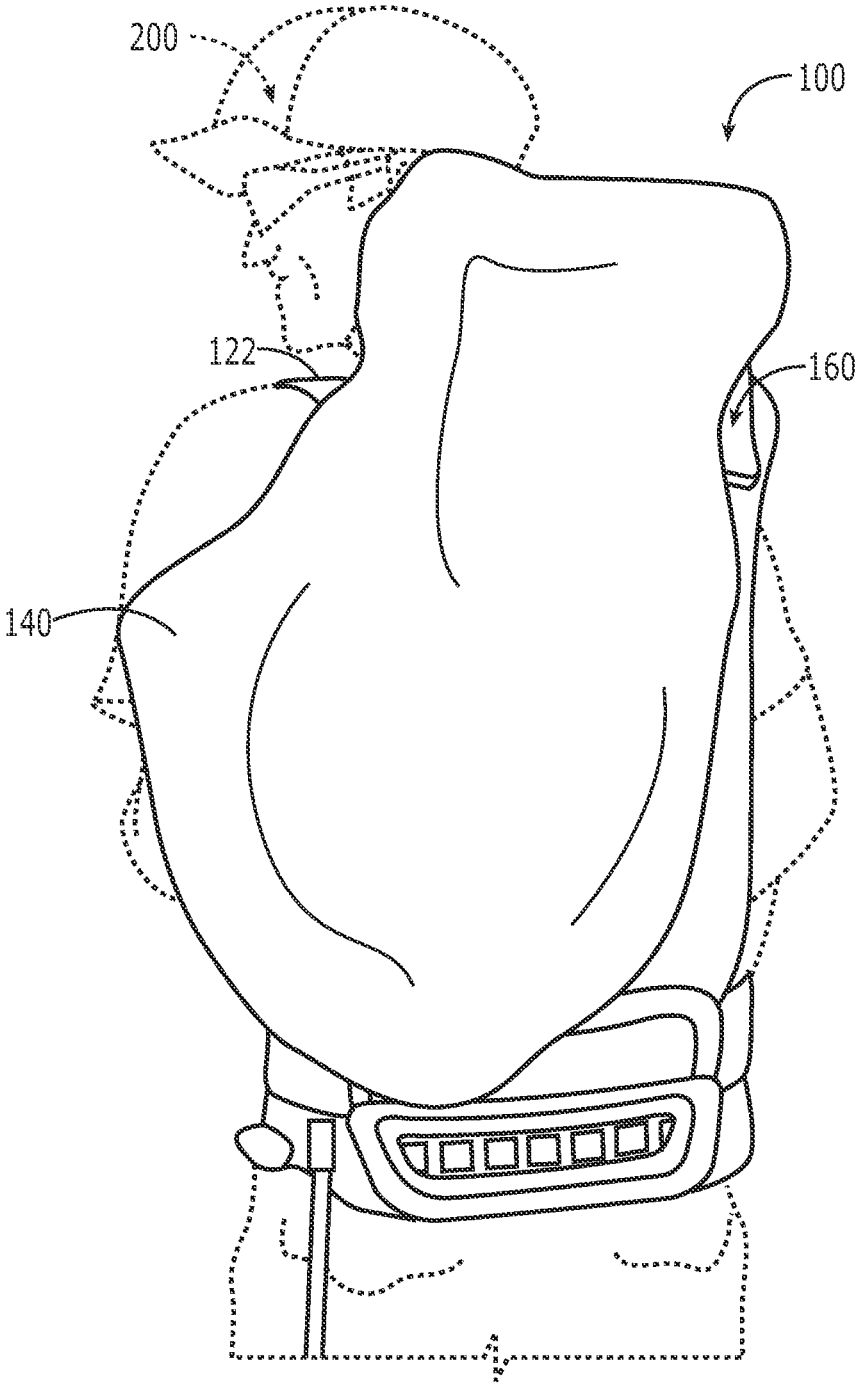
Figure 7C:
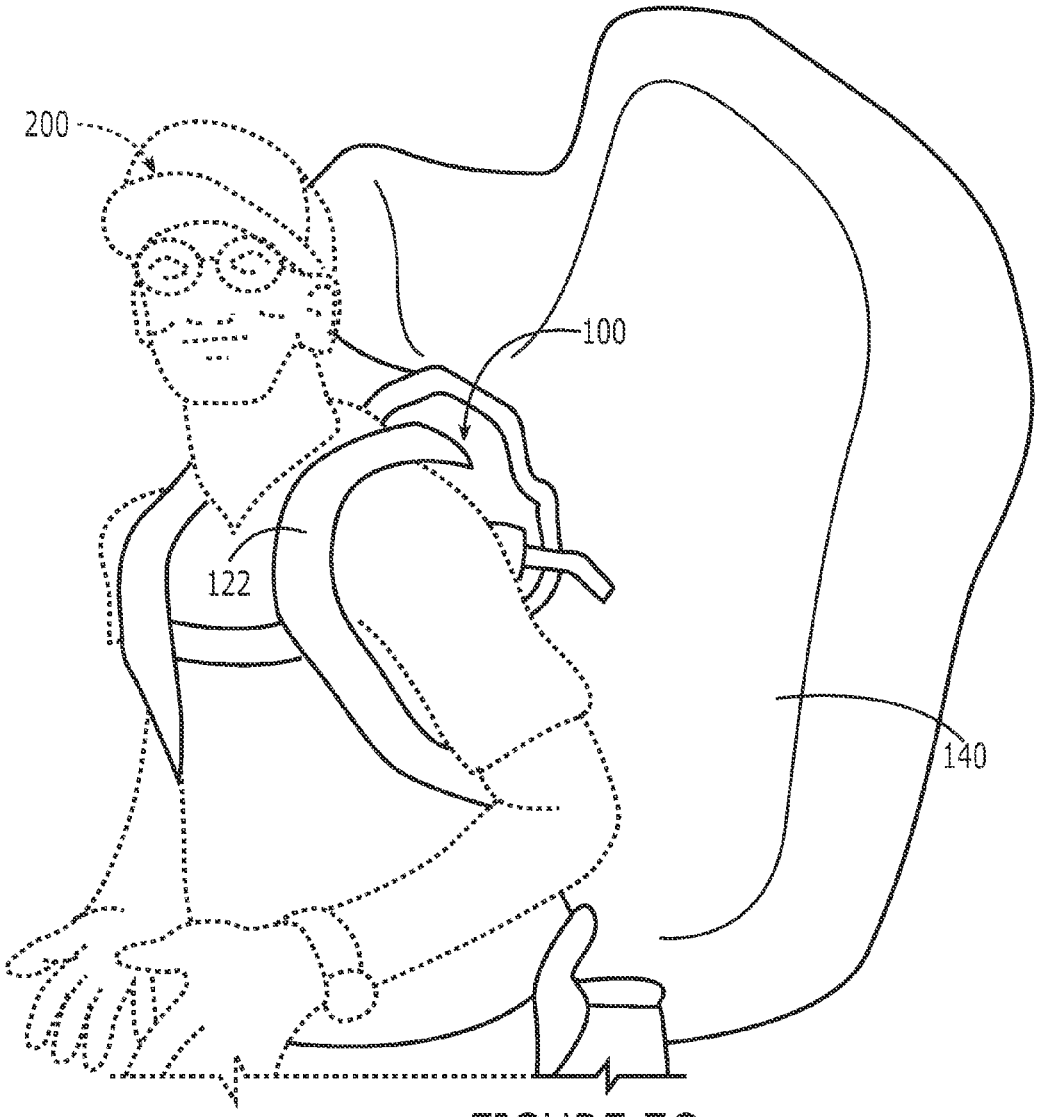

The harness 120 couples the system 100 to the user 200 as illustrated in FIGS. 7A-7C. The illustrated harness 120 in FIGS. 1-7 is a backpack-style unit, including a hip strap 124 and a shoulder strap 122. The backpack configuration provides an internal chamber separate from the inflatable chamber 140 within which the user may store items. The internal chamber is disposed between the user and the inflatable chamber 140 such that the inflatable chamber is distally disposed with respect to the remainder of the harness/backpack 120 and the user. Therefore, upon activation the inflatable chamber will be able to inflate without obstruction. The inflation system 160 is distal to the inflatable chamber 140 in the illustrated embodiment. The inflation system 160 may be disposed within a region configured to break away or articulate upon the inflation of the inflatable chamber 140, as illustrated in FIGS. 7A-C. The backpack or harness may further include various other straps and compartments in accordance with embodiments of the present invention. Alternatively, the harness may be any form of simple strapping apparatus configured to couple the system to the user.

Reference is next made to FIG. 2, which illustrates a schematic of the avalanche safety system illustrated in FIG. 1. The schematic diagram illustrates the operational relationship between various components of the system 100. The activation system 190 includes a switch 192. As discussed above, the activation system 190 is configured to receive a user-triggered action intended to activate the avalanche safety system 100 and inflate the inflatable chamber 140. The switch 192 is electrically coupled to the inflation system 160 between the battery 166 and the controller 172. As described above, the battery 166 stores electrical energy for use in inflating the inflatable chamber 140. The controller 172 is electrically coupled between the battery 166 and the motor 170. The controller 172 may provide a particular electrical inflation profile, including the modulation of current with respect to time. The motor 170 is electrically coupled to the controller 172 and fan 164 such that the modulated current from the controller 172 may be converted into mechanical rotation of the fan 164. The fan 164 is mechanically disposed between the air intake 180 and the inflatable chamber 140. In particular, an internal airway channel 168 connects the air intake 180, fan 164, and inflatable chamber 140 so as to minimize air loss. As discussed above, upon activation, the fan 164 generates a rotational force that creates a vacuum aligned with the illustrated arrows. The vacuum pulls external ambient air through the air intake 180, through the fan 164, and into the inflatable chamber 140.

Reference is next made to FIGS. 3*a-d*, which illustrate perspective views of the inflation system components. The battery 166 may be any type of electrical storage device including but not limited to a direct current battery of the type illustrated. The fan 164 may be a circular fan that facilitates engagement with the internal airway channel 168. The motor 170 may be any type of motor 170 configured to correspond to the battery 166 and controller 172 parameters. Likewise, the controller 172 may be configured according to the inflation objectives for the inflatable chamber 140.

Figure 4:
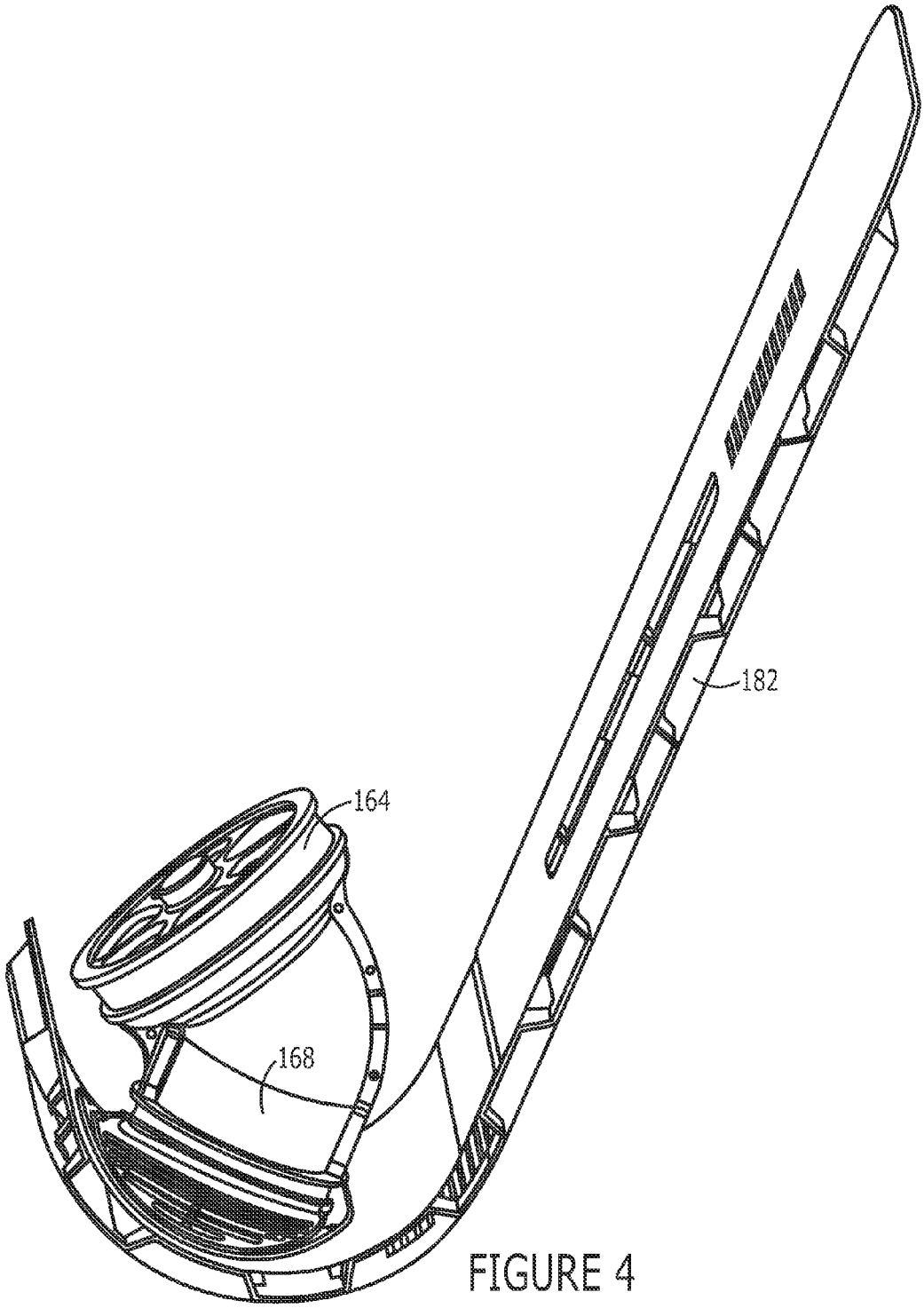
FIG. 4 illustrates a perspective view of the air intake frame, internal airway channel, and fan.

Reference is next made to FIG. 4, which illustrates a perspective view of the air intake frame 182, internal airway channel 168, and fan 164. The air intake frame 182 is part of the air intake 180. Various other air intakes may also be incorporated, including but not limited to the sides, bottom and front of the system 100. Increasing the number of air intake regions increases reliability of the air intake system during operation. The air intake frame 182 is a partially rigid member with a lateral vent structure as illustrated. In particular, the lateral vent structure includes a channel to the internal airway channel 168. Therefore, air/gas transmitted through the lateral vents may be routed to the internal airway channel 168. The air intake frame 182 includes rigid internal structure members in order to maintain the channel. The illustrated internal airway channel 168 is a cylindrical member coupled between the air intake frame 182 and the fan 164. The internal airway channel 168 substantially encloses the coupling so as to minimize air leakage between the air intake frame 182 and the fan 164. The fan 164 is coupled to the internal airway channel 164. The inflatable chamber 140 (not shown in FIG. 4) is coupled to the fan 164, either directly or via another internal airway channel member (not shown).

Figure 5:
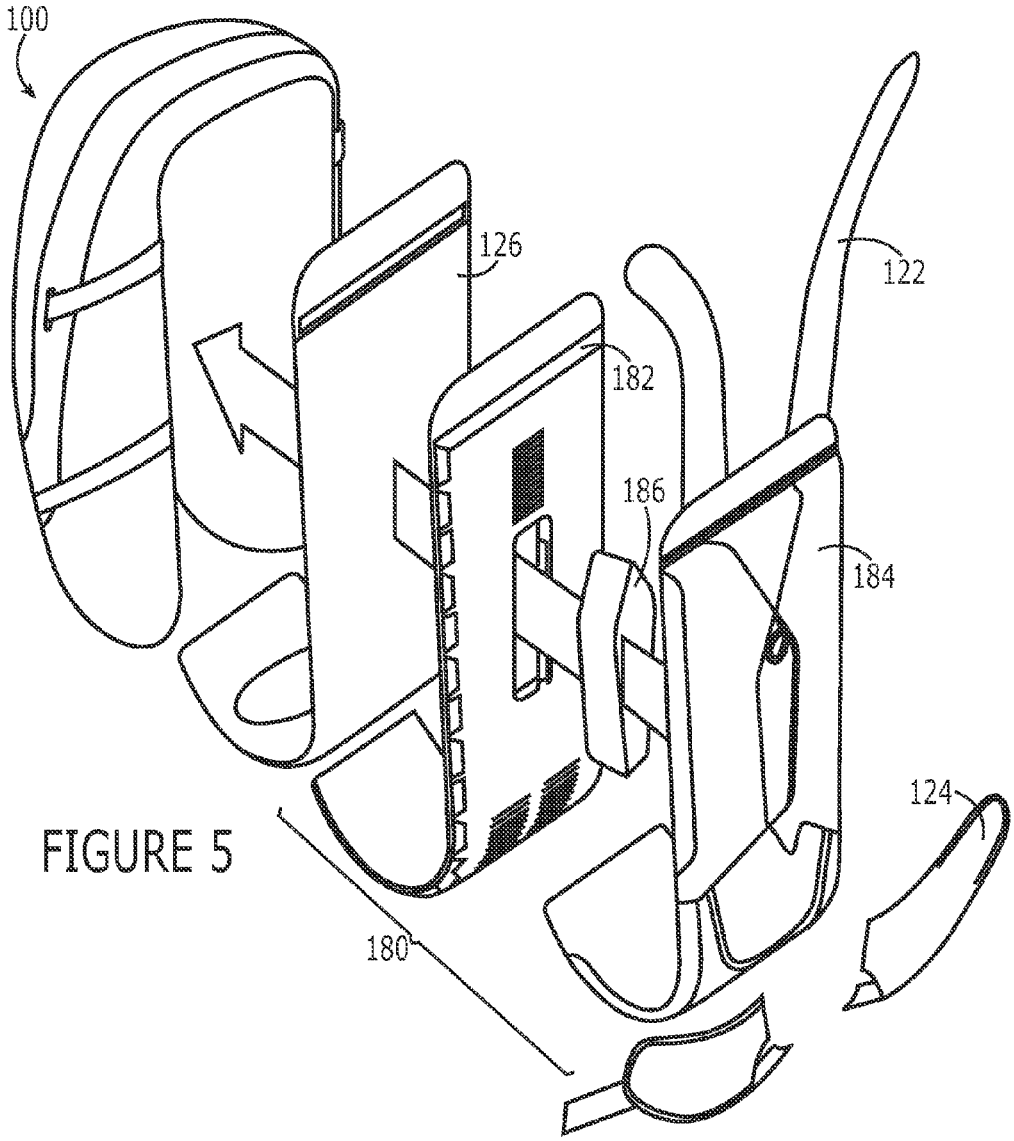
FIG. 5 illustrates an exploded view of the air intake with respect to the remainder of the avalanche safety system.

Reference is next made to FIG. 5, which illustrates an exploded view of the air intake 180 with respect to the remainder of the avalanche safety system. The air intake 180 includes the air intake frame 182 (illustrated in FIG. 4), a battery compartment 186, and a cover 184. The battery compartment 186 is configured to be disposed within the air intake frame 182. The positioning of the battery compartment 186 and the battery (not shown) with respect to the user is important because of the relative weight of most batteries. Therefore, positioning the battery 164 in a central region enables the shoulder 122 and hip straps 124 of the backpack (harness 120) to efficiently support the battery during operation. In addition, the battery 164 must be kept above a certain temperature for proper operation, and therefore positioning adjacent to the user ensures some amount of thermal insulation from the ambient temperature. The cover 184 includes padded regions and mesh regions. The padded regions facilitate user comfort and are disposed between the user and the air intake frame 182. The mesh regions are oriented to align with the lateral venting structure of the air intake frame 182. Therefore, ambient air may transmit through the mesh regions and into the air intake frame 182 as discussed above. Likewise, the mesh regions prevent debris from obstructing the vent structure of the air intake frame 182.

FIG. 5 further illustrates a frame 126 member of the backpack or harness 120. The frame 126 may include a rigid support region for further supporting the system with respect to the user. The exploded view illustrates the positioning of the air intake 180 and the frame 126 with respect to the remainder of the system 100. The hip/waist straps 124 and the shoulder straps 122 are also illustrated in the exploded view for positional reference.

Reference is next made to FIG. 6, which illustrates a flow chart of a method in accordance with another embodiment of the present invention. The method for inflating an inflatable chamber within an avalanche safety system comprises a plurality of acts. The illustrated method may be performed using the avalanche safety system 100 described above, or in correlation with an alternative avalanche safety system. The method includes receiving a user-triggered action intended to activate the avalanche safety system, 210. The user-triggered action may include a physical operation or gesture such as pulling a ripcord or depressing a button. Alternatively, the act of receiving a user-triggered action may include receiving a non-physical operation. Upon receipt of the user-triggered action, the method transmits ambient air to the inflatable chamber, 220. The act of transmitting ambient air to the inflatable chamber may include generating a vacuum that transmits ambient air through an internal airway channel to the inflatable chamber. The act of generating a vacuum may include using a fan and/or other electrical components. The inflatable chamber is inflated, act 230. The act of inflating the inflatable chamber may include inflation entirely with ambient air. The act of inflating the inflatable chamber may also include forming a particular three dimensional shape and internal pressure of the inflatable chamber. The inflation of the inflatable chamber thereby protects the user from an avalanche, act 240. The act of protecting the user from an avalanche may include cushioning the user from impact during the avalanche, elevating the user above the avalanche debris, and/or providing a breathing receptacle of ambient air.

Reference is next made to FIGS. 7A-7C, which illustrate an operational sequence of the system in FIG. 1 and the method of FIG. 6. FIG. 7A illustrates a user 200 with an avalanche safety system 100 in accordance with embodiments of the present invention. In particular, the user 200 is wearing the system 100 via a backpack harness structure including a set of hip/waist straps 124 and shoulder straps 122. The system includes an activation system 190 (not shown), inflation system 160, and inflatable chamber 140 as described above. FIG. 7A illustrates the inflatable chamber 140 in the compressed state so as to be contained within a region of the backpack. In addition, the system illustrated in FIG. 7A has not been activated, and therefore the user has not performed any type of user-triggered action upon the activation system 190. Prior to FIG. 7B, the user performs a particular user-triggered action such as pulling a ripcord or pressing a button to activate the system 100. As described above, the activation system includes an electrical coupling that activates the components of the inflation system 160. For example, activation of the activation system 190 may include switching a switch so as to remove electrical resistance between a battery and other electrical components. Upon activation, the inflation system 160 transmits ambient air to the inflatable chamber 140. FIG. 7B represents the transition from the compressed state to the inflated state of the inflatable chamber 140. The inflatable chamber 140 is partially filled with ambient air directed through an air intake 180, internal airway channel 168, and fan 164. A controller 172 may be used to inflate the inflatable chamber 140 according to a particular inflation profile. The inflation system 160 automatically translates in response to the inflation of the inflatable chamber 140. In the illustrated embodiment, the inflation system 160 is disposed within a region that is translating to the right as the inflatable chamber 140 is expanding. The inflation system 160 may be housed within a region with a releasable coupling (such as VELCRO) to the remainder of the system, thereby enabling automatic displacement in response to inflation. FIG. 7C illustrates complete transition to the inflated state of the inflatable chamber 140. The inflatable chamber 140 thereby forms a particular three dimensional shape and has a particular pressure. The particular three dimensional shape and pressure of the inflatable chamber are specifically selected to protect the user 200 from impact and provide flotation during an avalanche. Various alternative shapes and pressures may be utilized in accordance with embodiments of the present invention. The pressure within the inflatable chamber may be maintained for a particular time using a one way valve that seals the inlet from transmitting air out from the inflatable chamber 140. Likewise, the controller 172 may be configured to shut off and/or restart the fan 164 after a certain amount of time corresponding to complete inflation of the inflatable chamber 140.

Figure 8A:
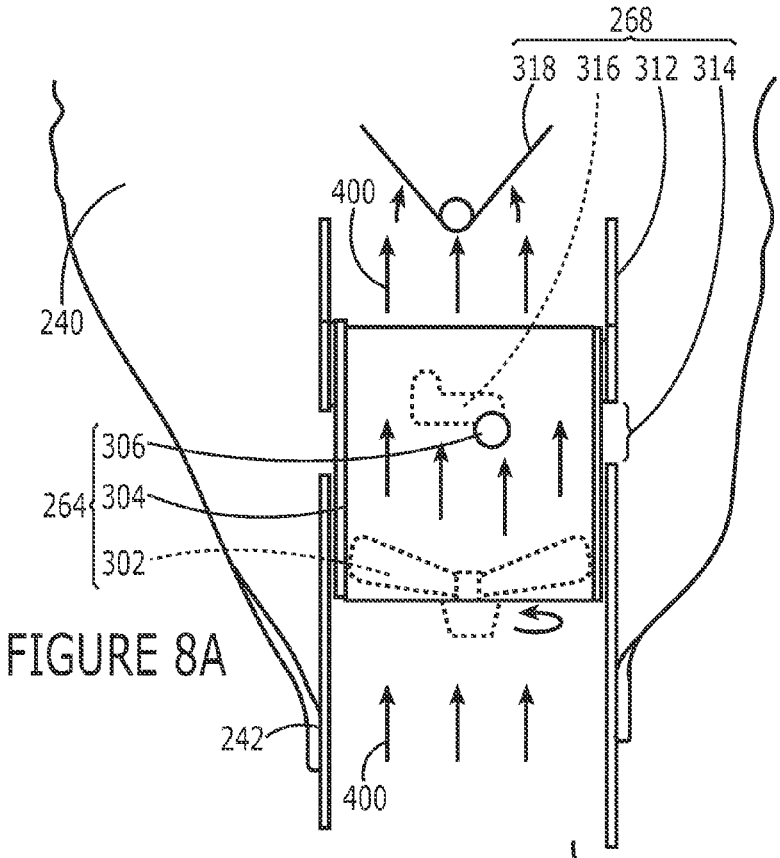
FIGS. 8A-8B illustrate an alternative inflation system embodiment including cross sectional views of the inflation and deflation positions of the fan with respect to the internal airway channel.
Figure 8B:
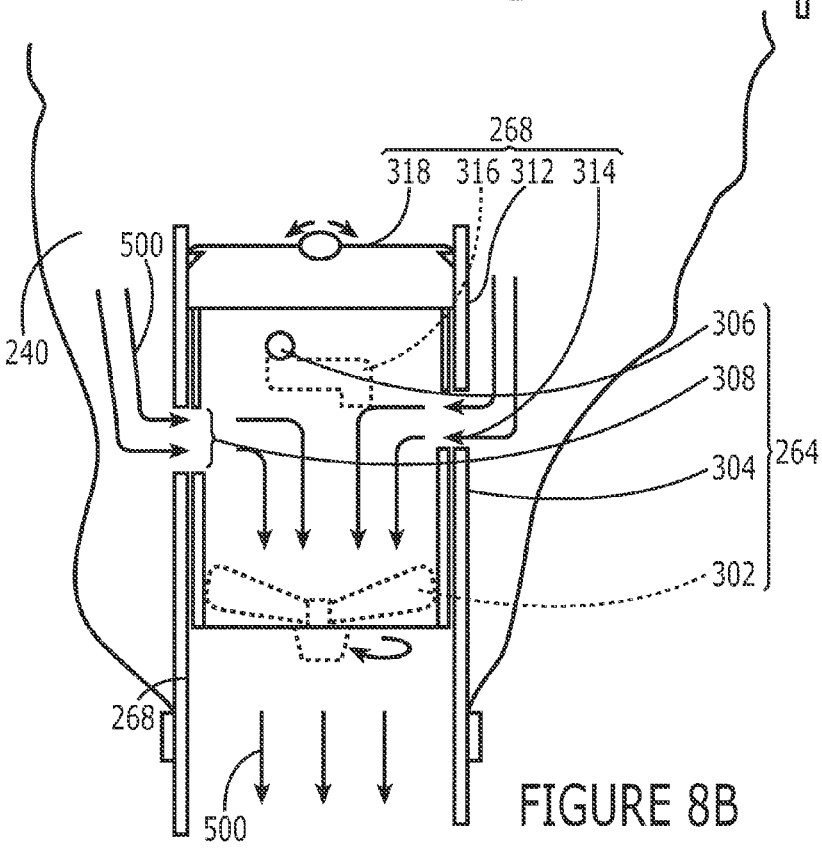

Reference is next made to FIGS. 8A-8B, which illustrate an alternative inflation system embodiment including cross sectional views of the inflation and deflation states of the fan 264 and internal airway channel 268. The fan 264 is moveably coupled within the internal airway channel 268 to facilitate the transition between the inflation position (FIG. 8A) and the deflation position (FIG. 8B) with respect to the internal airway channel 268. The inflatable chamber 240 is coupled to the internal airway channel 268 at a coupling location 242 between the fan 264 and the air intake (not shown). The coupling location 242 on the internal airway channel 268 is therefore proximal to the air intake (not shown) with respect to the fan 264.

The illustrated fan 264 includes a fan housing 304, a fan 302, a supportive member 306, and a fan housing opening 308. The illustrated internal airway channel 268 includes a channel 312, a channel opening 314, a supportive slot 316, and a valve 318. The fan housing 304 of the fan 264 is shaped to correspond to an internal region of the channel 312 of the internal airway channel 268 so as to facilitate the moveable coupling. For example, the illustrated fan housing 304 and channel 312 are cylindrically shaped and cross-sectionally sized to facilitate that the rotatable movement of the fan housing 304 within the channel 312. The fan 302 may be a bidirectional electric motorized fan configured to rotate at a particular speed and direction corresponding to an input current and polarity. The fan 302 is electrically coupled to the activation system (not shown). The supportive member 306 may be a protrusion or pin externally extending orthogonal from the fan housing 304. The supportive member 306 is disposed at a first radial position on the external surface of the fan housing 304. The fan housing opening 308 is a recess or opening in the external surface of the fan housing 308 that permits a channel between an internal region and an external region. The fan housing opening 308 is disposed at a second radial position on the external surface of the fan housing 308. The channel 312 of the internal airway channel 268 is an elongated member that extends between the inflatable chamber 240 and the air intake (not shown). The channel 312 includes a substantially enclosed internal region to facilitate the transmission of air. The channel opening 314 is an opening in the channel 312 between the substantially enclosed internal region and an external region. The channel opening 314 is disposed at a first radial position on the external surface of the channel 312. The supportive slot 316 is a recess or opening in at least the internal surface of the channel 312 configured to correspond to the supportive member 306 of the fan 264. The supportive slot 316 is shaped to permit the supportive member 306 to move between at least two positions in at least one radial plane. For example, the illustrated supportive slot 316 is shaped to permit the corresponding illustrated supportive member 306 to move in both a rotational plane and a lengthwise plane. The supportive slot 316 is disposed at a second radial position on the channel 312. The valve 318 is disposed on a distal end of the channel 312 adjacent to the inflatable member 240. The valve 318 is oriented and configured to both permit air flow away from the channel 312 into the inflatable chamber 240 and restrict air flow out of into the channel 312 away from the inflatable chamber 240. The orientation and configuration of the valve 318 permits the inflatable chamber 240 to inflate and maintain a particular internal air pressure. Various valves may be used in accordance with embodiments of the present invention.

The inflation position of the fan 264 illustrated in FIG. 8A is configured to enable the active transmission of ambient air 400 through the internal airway channel 268 and into the inflatable chamber 240. The illustrated fan 264 is configured to move both rotationally and lengthwise with respect to the internal airway channel 268. The inflation position of the fan 264 is configured to not rotationally align the fan housing opening 308 and the channel opening 314, thereby containing all air within the internal region of the channel 312. The inflation position of the fan 264 corresponds to a particular rotational and lengthwise position of the fan housing 304 and supportive member 306 with respect to the channel 312 and supportive slot 306. respectively. The rotation of the fan 302 configured to transmit ambient air 400 into the inflatable chamber 204 creates both a torque force and a rotational force configured to bias the fan 264 to move with respect to the internal airway channel 268 into the inflation position. This biasing correspondence includes radially disposing the supportive member 306, fan housing opening 308, supportive slot 316, and channel opening 314 at particular radial locations. For example, the torque force and rotational force created by the fan 302 in the illustrated inflation position embodiment causes the fan 264 to rotate and translate in a manner than causes the supportive member 302 to translate rotationally and lengthwise through the supportive slot 316 to the illustrated bottom right location. The valve 318 is also correspondingly oriented with respect to the fan 264 to permit air flow into the inflatable chamber 240.

The deflation position of the fan 264 illustrated in FIG. 8B is configured to enable the active transmission of ambient air 500 from the inflatable chamber 240 and into the internal airway channel 268. The illustrated fan 264 is configured to move both rotationally and lengthwise with respect to the internal airway channel 268. The deflation position of the fan 264 is configured to rotationally align the fan housing opening 308 and the channel opening 314. Thereby, permitting air 500 from within the inflatable chamber 240 to transmit into the internal region of the channel 312. The deflation position of the fan 264 corresponds to a particular rotational and lengthwise position of the fan housing 304 and supportive member 306 with respect to the channel 312 and supportive slot 306, respectively. The rotation of the fan 302 configured to transmit ambient air 500 away from the inflatable chamber 204 creates both a torque force and a rotational force configured to bias the fan 264 to move with respect to the internal airway channel 268 into the deflation position. This biasing correspondence includes radially disposing the supportive member 306, fan housing opening 308, supportive slot 316, and channel opening 314 at particular radial locations. For example, the torque force and rotational force created by the fan 302 in the illustrated deflation position causes the fan 264 to rotate and translate in a manner than causes the supportive member 302 to translate rotationally and lengthwise through the supportive slot 316 to the illustrated top left location. The valve 318 is also correspondingly oriented with respect to the fan 264 to restrict air flow from the inflatable chamber 240 into the internal airway channel 268.

Reference is next made to FIGS. 9-11 which illustrate an alternative inflation system 600 including a fan 680 and a housing 640. The alternative inflation system 600 is coupled with respect to the internal airway channel of an avalanche safety system substantially adjacent to the inflatable chamber. The housing 640 may be fixably coupled to the internal airway channel such that the fan 680 is moveable with respect to both the housing 640 and the internal airway channel. The alternative inflation system 600 may be coupled within, partially within, and/or on an end region of the internal airway channel substantially adjacent to the inflatable chamber in accordance with embodiments of the present invention.

The housing 640 includes a first opening 642, a biasing magnet 644, a fan enclosure 646, a valve 648, and a second opening 650. The illustrated housing 640 is shaped in a general capsule but it will be appreciated that various elongated shapes may be utilized in accordance with embodiments of the present invention. The housing 640 is configured to contain the fan 680 and permit selective transmission of air through the first and second openings 642, 650. The first and second openings 642, 650 are porous regions configured to permit air flow through a plurality of recesses/holes. The size of the recesses in the first and second openings 642, 650 may be configured to protect the fan from obstructions caused by transmission of solid and semi-solid objects. The shape of the holes in the first and second openings 642, 650 may also be configured to provide structural integrity to the overall housing 640 shape. In addition, the holes may be shaped and oriented to affect one or more characteristics of the air flow. The fan enclosure 646 is a region disposed between the first and second openings 642, 650 configured to moveably contain the fan 680. The fan enclosure 646 is correspondingly shaped with the fan 640 to permit the fan 680 to move in at least one plane. In the illustrated embodiment, the fan enclosure 646 is configured to permit the fan 680 to translate lengthwise with respect to the housing 640. The fan enclosure 646 includes an internal region that corresponds to the external shape of the fan 680 so as to permit the translation while maintaining containment within the housing 640. It will be appreciated that various other moveable containment configurations may also be utilized between the fan enclosure 646 and the fan 680, including but not limited to a rotational movement. The biasing magnet 644 is disposed substantially between the first opening 642 and the fan enclosure 646. The illustrated fan enclosure 646 is cylindrically shaped to permit the lengthwise translation of the fan 680. The biasing magnet 644 is polarized, positioned, and oriented to create a biasing coupling force with the fan 680 when it is positioned adjacent to the first opening 642 (FIGS. 9A, 9C, 10A, 10C, 11A, 11C). Alternatively, a spring or other biasing mechanism may be used between the housing 640 and the fan 680 to generate the biasing force toward the position in which the fan 680 is substantially adjacent to the first opening 642. The valve 648 is positioned between the fan enclosure 646 and the second opening. The valve is independently oriented to allow/unrestrict airflow directed away from the fan 680 and prevent/restrict airflow directed toward the fan 680. In particular, the valve 648 includes at least one articulating member configured to pivot between a restricted position and various angled open positions. The restricted position includes orienting the at least one articulation member orthogonal to the lengthwise orientation of the housing 640 and covering a recess between the fan enclosure 646 and the second opening 650. The various angled positions of the valve 648 include angling the at least one articulation member away from the fan enclosure 646 at a particular angle. The valve 648 may be composed of various materials, including but not limited to plastic and rubber. The valve 648 is biased toward the restricted position, thereby restricting airflow between the fan enclosure 646 and the second opening 650. The second opening 650 may be shaped to contain the valve in both the restricted position and the various angled open positions.

The fan 680 includes a blade 686 (not shown), electrical couplers (not shown), a fan magnet 682, a fan frame 684, and a deflation member 688. The blade 686 may be any type of conventional fan blades including but not limited to a three pad angled configuration. The blade 686 is electrically coupled to a motor (not shown) and to a set of electrical couplers (not shown) to enable bidirectional rotation. The blade 686 is enclosed within an internal region of the fan frame 684 to support the orientation of the blade 686. The fan frame 684 includes an external shaped region configured to correspond to the internal shape of the fan enclosure 646 of the housing 640. In the illustrated embodiment, the externally shaped region of the fan frame 684 is substantially cylindrically shaped and sized to correspond to the internal cylindrically shaped region of the fan enclosure 646. The correspondence between the external shape of the fan frame 684 and the internal region of the fan enclosure 646 also permits the moveable translation of the fan frame 684. The fan magnet 682 is disposed on a first lengthwise side of the fan frame 684 and is polarized, oriented, and positioned to correspond to the biasing magnet 644 of the housing 640. In particular, when the fan frame 684 is disposed adjacent to the first opening 642, the fan magnet 682 and biasing magnet 644 generate a biasing coupling force. The deflation member 688 is an extended member disposed on a second lengthwise side of the fan frame 684 corresponding to the second opening 650 side of the fan enclosure 646. The deflation member 688 is shaped, oriented, and positioned to angle open the valve 648 when the fan frame 684 is translated toward the second opening 650.

Figure 9A:
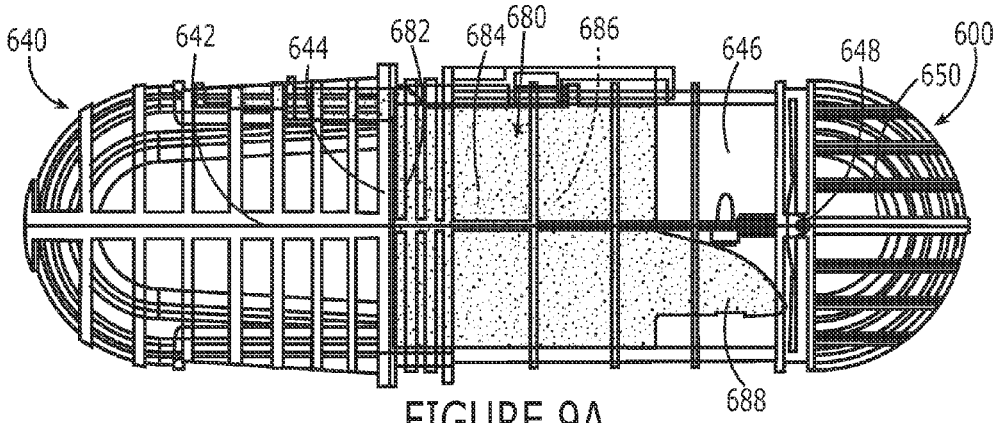
FIGS. 9A-C illustrate profile views of a second alternative inflation system embodiment with the inflation system in a rest state, inflation state, and deflation state respectively.
Figure 9B:
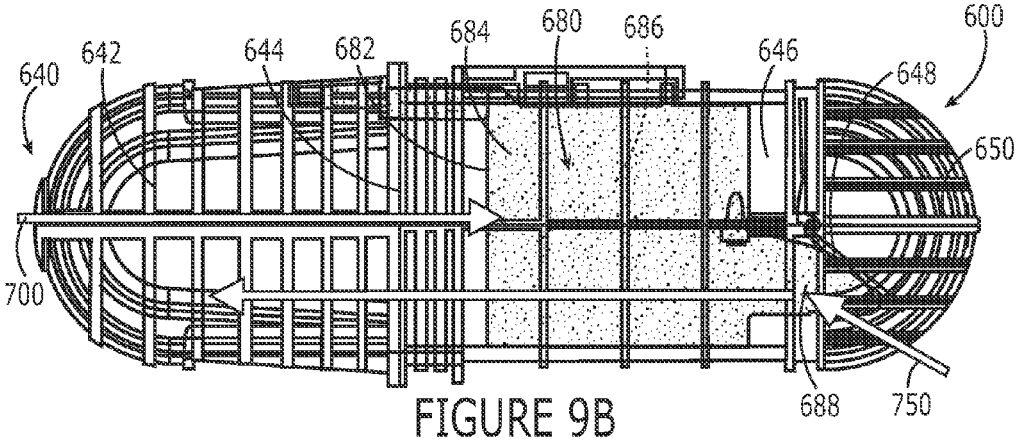
Figure 9C:
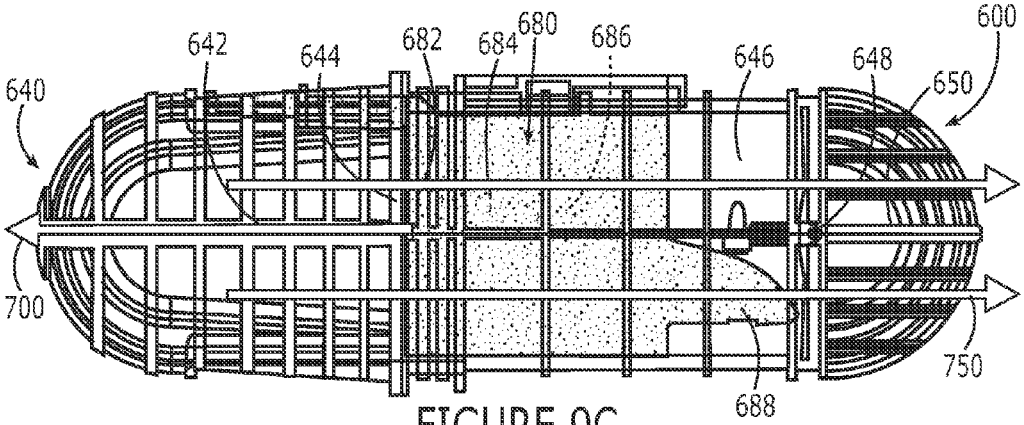
Figure 10A:
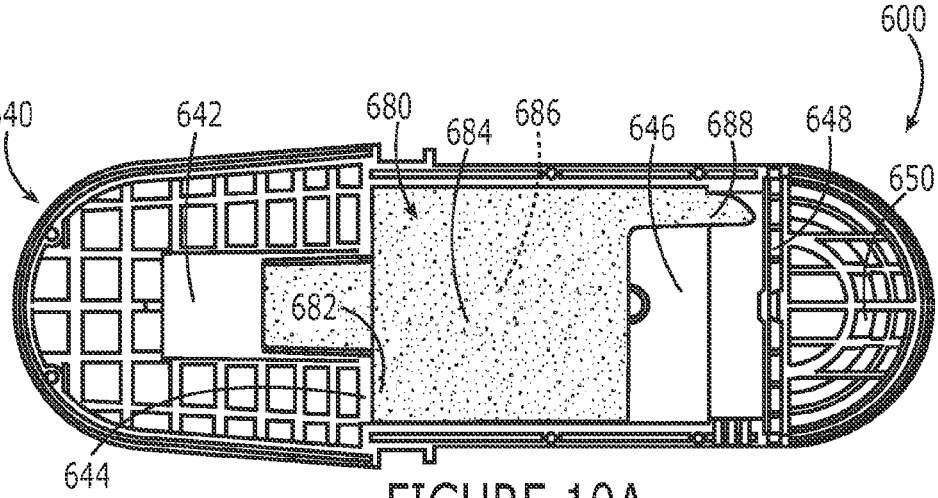
FIGS. 10A-C illustrate cross-sectional views of the alternative inflation system illustrated in FIGS. 9A-C with the fan in a rest state, inflation state, and deflation state respectively.
Figure 10B:
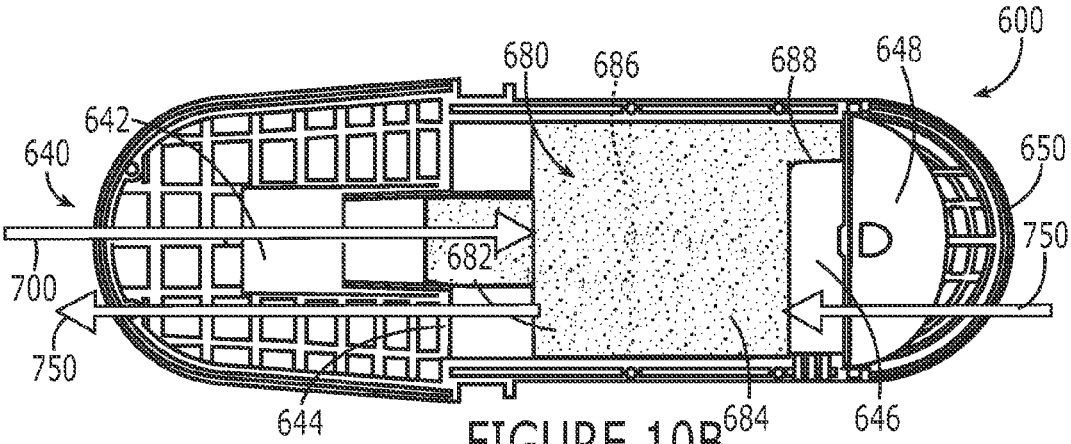
Figure 10C:
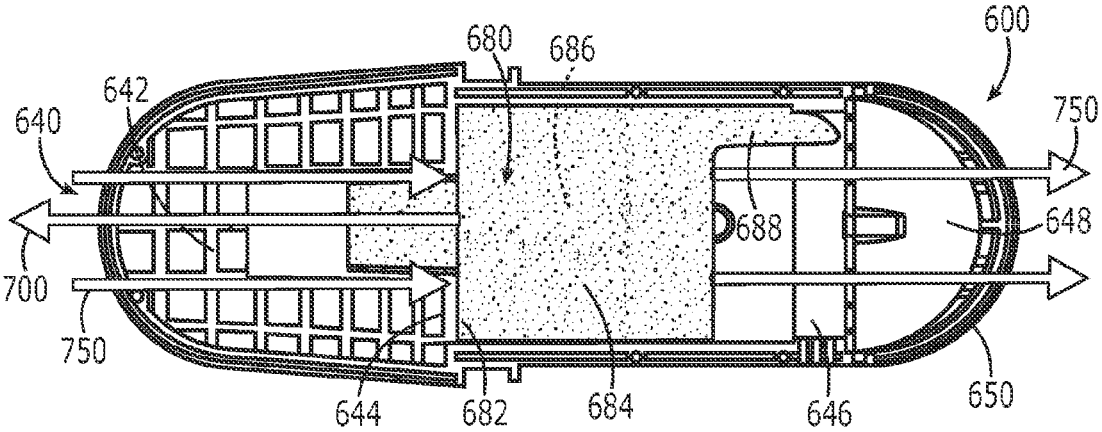
Figure 11A:
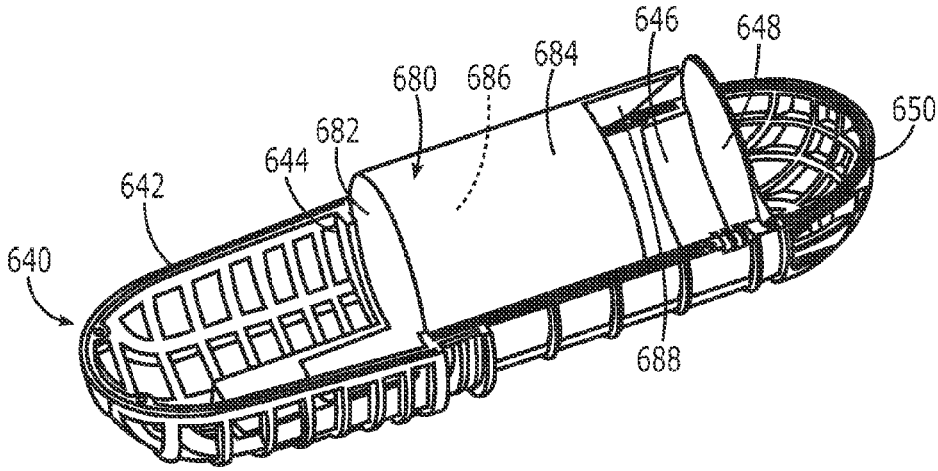
FIGS. 11A-C illustrate partial cross-sectional views of the alternative inflation system illustrated in FIGS. 9A-C with the fan in a rest state, inflation state, and deflation state respectively.
Figure 11B:
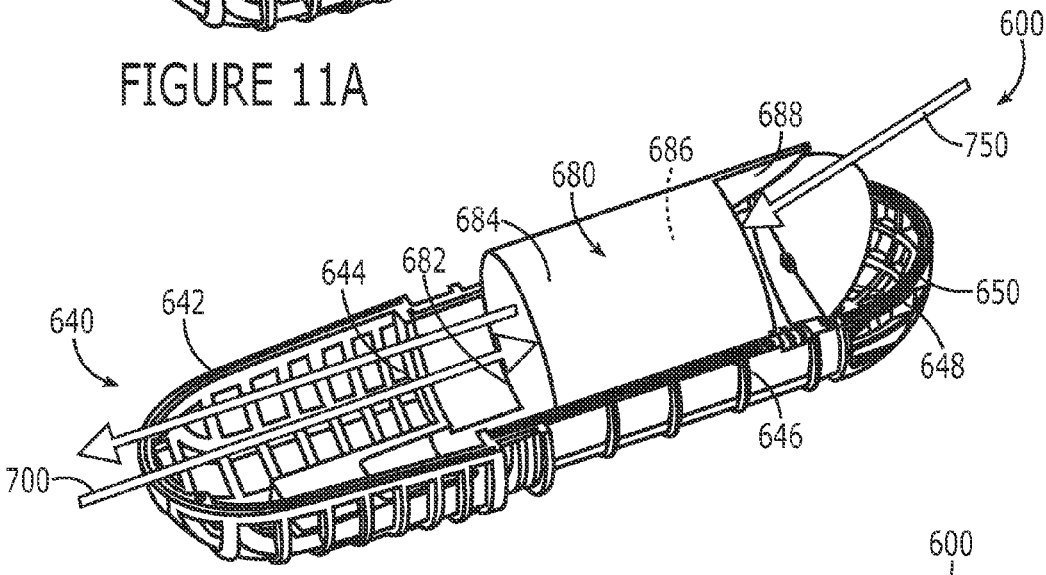
Figure 11C:
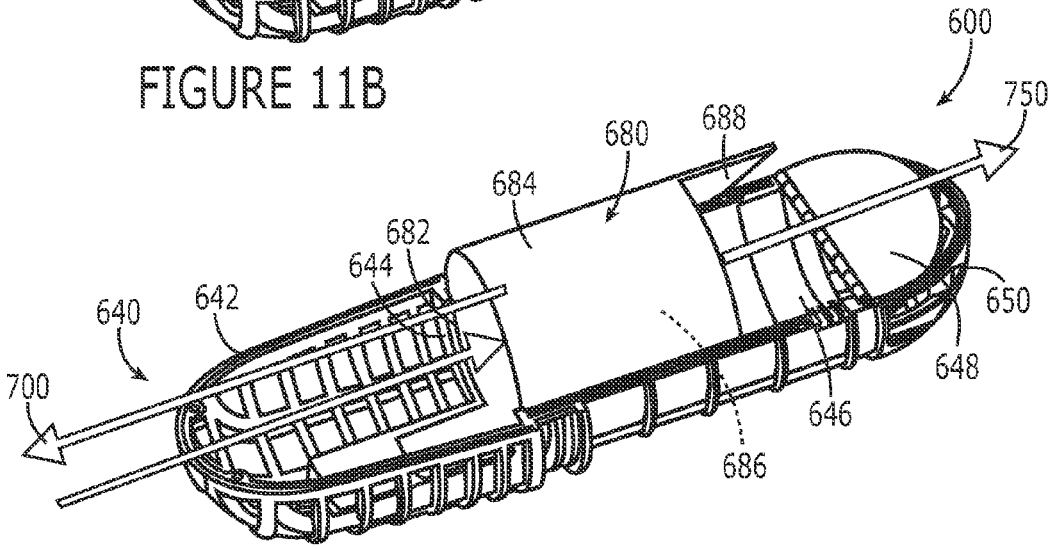

In operation, the inflation system 600 may be in a rest state (FIGS. 9A, 10A, 11A), a deflation state (FIGS. 9B, 10B, 11B), or an inflation state (FIGS. 9C, 10C, 11C). Each respective state will be described in more detail below. The inflation system 600 is further configured to selectively engage both active inflation and deflation of a corresponding inflation chamber. The selective engagement of the rest, deflation, and inflation states of the inflation system 600 are controlled by the activation system portion of the overall avalanche safety system. The term "active" refers to the fan actively transmitting air within or out of the inflatable chamber. In contrast, a "passive" inflation/deflation would require a user to manually inflate or deflate the inflatable chamber via manual air transmission (blowing), physical force (opening or compression on the inflatable chamber), etc.

FIGS. 9A, 10A, 11A illustrate the inflation system 600 in a default or rest state. The rest state corresponds to any situation other than inflation or deflation of the inflatable chamber. For example, the rest position may correspond to the user wearing the avalanche safety system in a ready state while performing a skiing activity. Likewise, the rest position may correspond to maintaining the inflatable chamber in an inflated state after the inflation process. As discussed above, the fan 680 is moveably contained within the fan enclosure 646 portion of the housing 640 to permit the fan 680 to translate in a lengthwise orientation. The rest position of the fan 680 includes the fan 680 positioned substantially adjacent to the first opening 642. A biasing force generated by the biasing magnet 644 and the fan magnet 682 urge the fan 680 to translate toward the first opening 642. Therefore, in the absence of other forces upon the fan 680, the biasing force urges the fan 680 to translate toward first opening 642 and the rest position. It will be appreciated that a similar biasing force may be generated alternatively by other biasing configurations between the fan 680 and the housing 640 including but not limited to an extension spring. The valve 648 is in the restricted position, thereby covering the recess between the fan enclosure 646 and the second opening 650. The restricted position also restricts all airflow between the fan enclosure 646 and the second opening 650. As a result of the fan 680 translating toward the first opening 642, the deflation member 688 is contained within the fan enclosure 646 and does not affect the valve 648.

FIGS. 9B, 10B, 11B illustrate the inflation system 600 in a deflation state. The deflation state is configured to actively transmit air out of the inflatable chamber. Therefore, the deflation state of the inflation system 600 corresponds to actively transmitting air from the second opening 650 to the first opening 642 via the fan 680. In the deflation state, the fan blade 686 is selectively engaged to rotate in an orientation that causes a thrust force 700 upon the fan frame 684 oriented toward the second opening 650. The thrust force 700 thereby causes the fan 680 to translate within the fan enclosure 646 toward the second opening 650. It will be appreciated that the biasing force generated between the biasing magnet 644 and the fan magnet 682 is specifically configured to enable the thrust force 700 to overcome the biasing force and thereby permit the fan 680 to translate toward the second opening 650. The translation of the fan 680 thereby causes the deflation member 688 to push open the valve 648 of the housing 640. The opening of the valve 648 creates an airflow channel between the second opening 650 and the first opening 642. The rotation of the fan blade 686 simultaneously to the thrust force 700 produces an airflow force 750 oriented from the second opening 650 to the first opening 642. The air flow force 750 thereby actively transmits air from the second opening 650 to the first opening 642 and correspondingly transmits air out of the inflatable chamber coupled to the second opening (not shown). Once the deflation of the inflatable chamber is complete, the activation system may deactivate the rotation of the fan blade 686, causing the inflation system to return to the rest state (FIGS. 9A, 10A, 11A). The activation system may be configured to automatically engage the deflation state of the inflation system 600 according to a particular operational algorithm. The operational algorithm may include various parameters including but not limited to a duration of time subsequent to inflation, a user-selected action indicating accidental inflation, a gyroscopic position, etc. The activation system may also be configured to automatically shut off the deflation state according to one or more criteria such as the complete deflation of the inflatable chamber.

FIGS. 9C, 10C, 11C illustrate the inflation system 600 in an inflation state. The inflation state is configured to actively transmit air into of the inflatable chamber so as to pressurize the inflatable chamber to a particular pressure. Therefore, the inflation state of the inflation system 600 corresponds to actively transmitting air from the first opening 642 to the second opening 650 via the fan 680. In the inflation state, the fan blade 686 is selectively engaged to rotate in an orientation that causes a thrust force 700 upon the fan frame 684 oriented toward the first opening 650. The thrust force 700 thereby urges the fan 680 to translate within the fan enclosure 646 toward the first opening 642. The translation of the fan 680 thereby causes the deflation member 688 to be contained within the fan enclosure 646 of the housing 640. The rotation of the fan blade 686, simultaneously to the thrust force 700, produces an airflow force 750 oriented from the first opening 642 to the second opening 650. The air flow force 750 thereby actively transmits air from the first opening 642 to the second opening 650 and correspondingly transmits air into the inflatable chamber from the internal airway channel and air intake (not shown). The activation system may be configured to automatically disengage the inflation state of the inflation system 600 when the inflatable chamber is pressurized to a particular pressure and/or if a user action indicates that the selective inflation was accidental or a mistake.

Figure 12B:
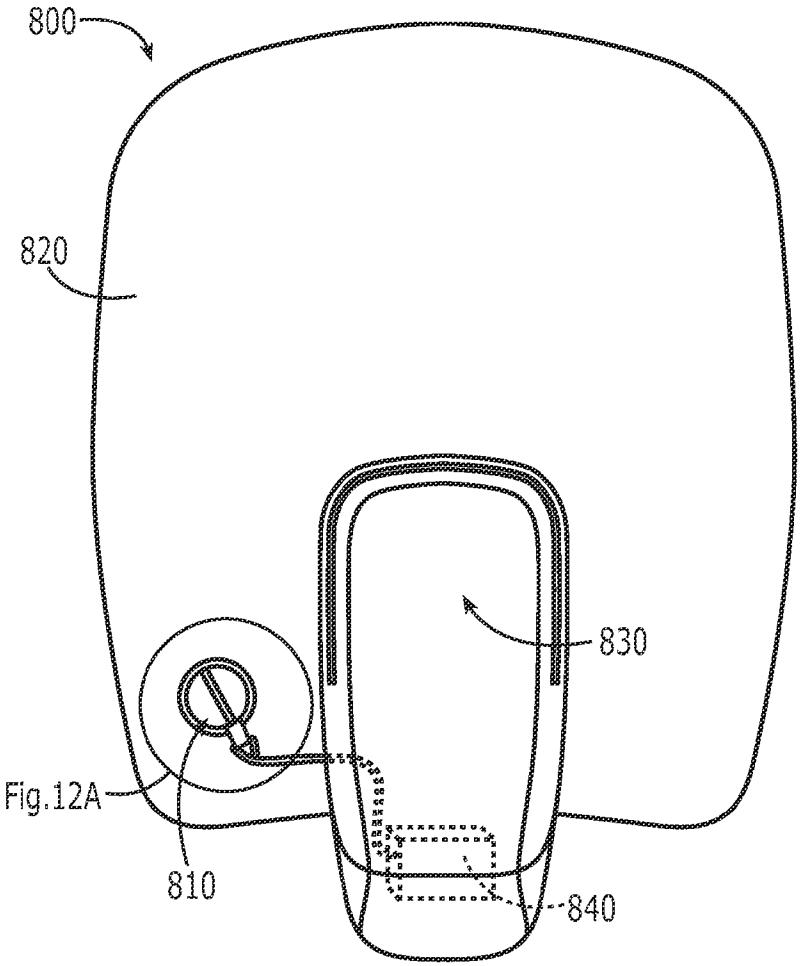
FIGS. 12A-B illustrate an avalanche safety system with an alternative inflation system including an automatic deflation configuration that utilizes a valve disposed on an external surface of the inflatable chamber.
Figure 12A:
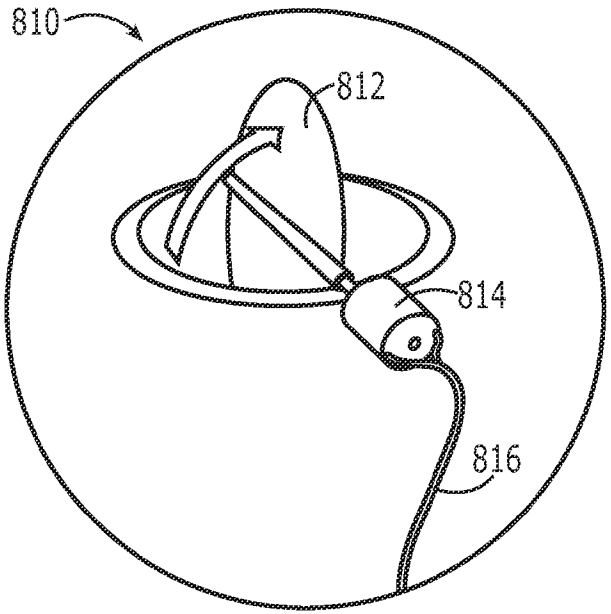

Reference is next made to FIGS. 12A-B, which illustrate an avalanche safety system with an alternative inflation system including an automatic deflation configuration that utilizes a valve disposed on an external surface of the inflatable chamber, designated generally at 800. It will be appreciated that the illustrated deflation system may be incorporated within either a fan based inflation system (FIGS. 1-11) or via a conventional compressed gas based inflation system. The illustrated system 800 includes an inflatable chamber 820, a harness 830, a deflation mechanism 810, and a controller 840. The deflation mechanism 810 is disposed on an external surface of the inflatable chamber 820, thereby creating an independent channel between the internal region of the inflatable chamber 820 and the ambient region external of the system 800. The illustrated harness 830 is a backpack similar to the embodiments illustrated in FIGS. 1-7. The controller 840 is coupled to the deflation mechanism 810 so as to enable remote operation. The controller 840 may include various electrical components including but not limited to a power source, switch, processor, sensor, etc. The controller 840 may include various sensors and processors so as to coordinate operation of the deflation mechanism 810 with one or more values. The one or more values may include time and three dimensional position of the user. For example, the controller 840 may be configured to automatically activate the deflation mechanism 810 after a particular period of time and/or a particular three dimensional position of the user. A processor may record time after the inflatable chamber is inflated, and a gyroscopic sensor may detect the three dimensional position of the user. Therefore, the deflation mechanism 810 may be automatically engaged if either a particular period of time passes after inflation or the user is oriented in a manner that corresponds to a likely burial.

The deflation mechanism 810 further includes a valve 812, actuator 814, and controller coupling 816. The illustrated valve 812 is a circular recess rotational valve. The valve 812 includes an open state (illustrated in FIG. 12A) and a closed state (illustrated in FIG. 12B). The open state of the valve 812 opens a channel between an external ambient region and the internal region of the inflatable chamber 820. The closed state of the valve 812 obstructs the channel to the internal region of the inflatable chamber 820. It will be appreciated that the illustrated channel to the internal region of the inflatable chamber 820 is independent of the internal channel through which the inflatable chamber is inflated. The valve 812 is coupled to the actuator 814. The actuator 814 is configured to receive an electrical input via the controller coupling 816 and mechanically switch the valve 812 between the open and closed states. For example, a particular current may be transmitted from the controller 840 to the actuator 814 via the controller coupler 816, thereby causing the actuator 814 to mechanically transition the valve 812 from the closed state to the open state. Likewise, when the electrical current is removed, the actuator 814 may automatically transition the valve 812 from the open state back to the closed state. It will be appreciated that various types of remote operation valves may be utilized in accordance with embodiments of the present invention.

Figure 13B:
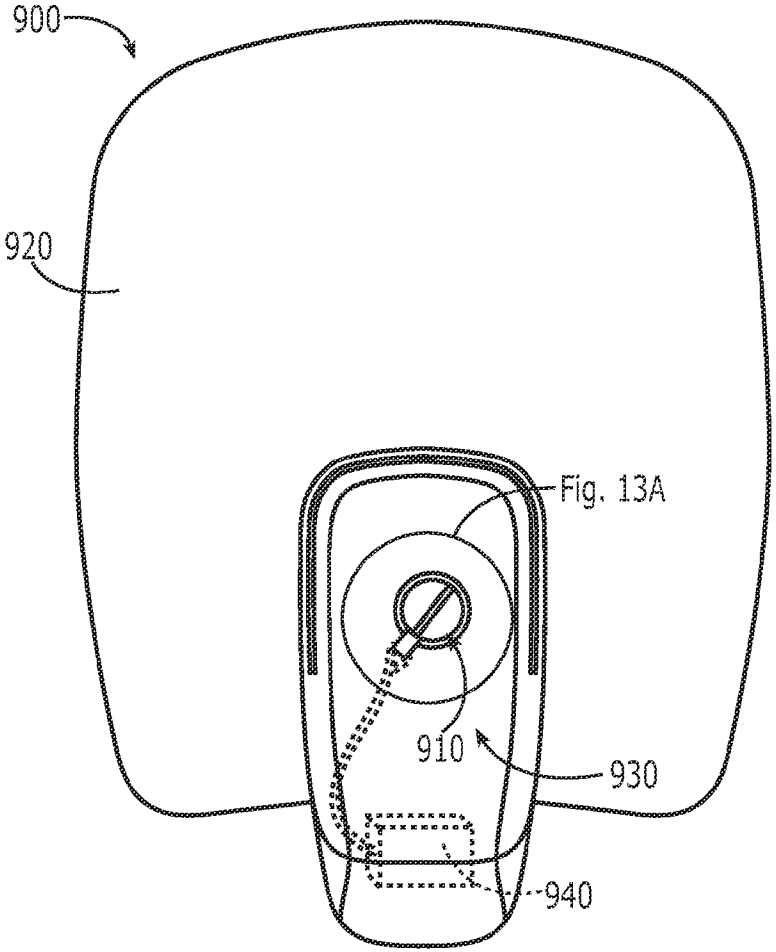
FIGS. 13A-B illustrate an avalanche safety system with an alternative inflation system including an automatic deflation configuration that includes a valve disposed on a portion of the harness.
Figure 13A:
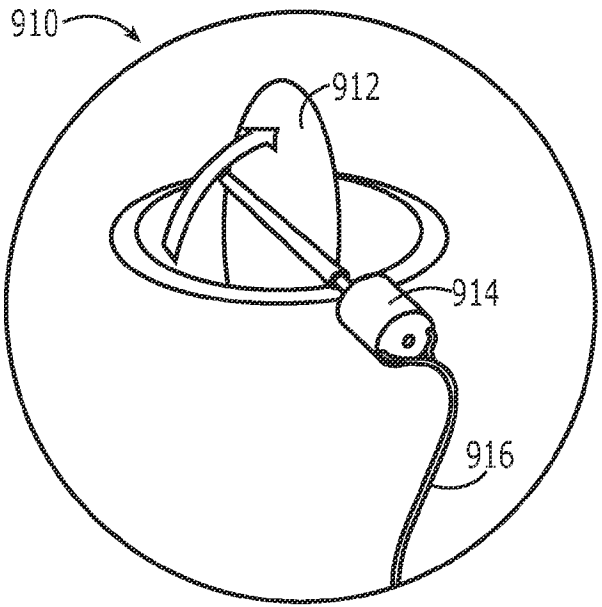

Reference is next made to FIGS. 13A-B, which illustrate an avalanche safety system with an alternative inflation system including an automatic deflation configuration that includes a valve disposed on a portion of the harness, designated generally at 900. It will be appreciated that the illustrated deflation system may be incorporated within either a fan based inflation system (FIGS. 1-11) or via a conventional compressed gas based inflation system. The illustrated system 900 includes an inflatable chamber 920, a harness 930, a deflation mechanism 910, and a controller 940. The deflation mechanism 910 is disposed on an external surface of the harness 930, thereby creating a channel between the internal region of the inflatable chamber 820 and the ambient region external of the system 900. The illustrated harness 930 is a backpack similar to the embodiments illustrated in FIGS. 1-7. The controller 940 is coupled to the deflation mechanism 910 so as to enable remote operation. The controller 940 may include various electrical components, including but not limited to a power source, switch, processor, sensor, etc. The controller 940 may include various sensors and processors so as to coordinate operation of the deflation mechanism 910 with one or more values. The one or more values may include time and three dimensional position of the user. For example, the controller 940 may be configured to automatically activate the deflation mechanism 910 after a particular period of time and/or a particular three dimensional position of the user. A processor may record time after the inflatable chamber is inflated, and a gyroscopic sensor may detect the three dimensional position of the user. Therefore, the deflation mechanism 910 may be automatically engaged if either a particular period of time passes after inflation or the user is oriented in a manner that corresponds to a likely burial.

The deflation mechanism 910 further includes a valve 912, actuator 914, and controller coupling 916. The illustrated valve 912 is a circular recess rotational valve. The valve 912 includes an open state (illustrated in FIG. 13A) and a closed state (illustrated in FIG. 13B). The open state of the valve 912 opens a channel between an external ambient region and the internal region of the inflatable chamber 920. The closed state of the valve 912 obstructs the channel to the internal region of the inflatable chamber 920. It will be appreciated that the illustrated channel to the internal region of the inflatable chamber 820 may overlap or depend on the internal channel through which the inflatable chamber is inflated. The valve 912 is coupled to the actuator 914. The actuator 914 is configured to receive an electrical input via the controller coupling 916 and mechanically switch the valve 912 between the open and closed states. For example, a particular current may be transmitted from the controller 940 to the actuator 914 via the controller coupler 916, thereby causing the actuator 914 to mechanically transition the valve 912 from the closed state to the open state. Likewise, when the electrical current is removed, the actuator 914 may automatically transition the valve 912 from the open state back to the closed state. It will be appreciated that various types of remote operation valves may be utilized in accordance with embodiments of the present invention.

It should be noted that various alternative system designs may be practiced in accordance with the present invention, including one or more portions or concepts of the embodiment illustrated in FIGS. 1-13 or described above. Various other embodiments have been contemplated, including combinations in whole or in part of the embodiments described above.

What is claimed is:

1. An inflatable avalanche safety system comprising:

an inflatable chamber including a compressed state and an inflated state, wherein the inflated state forms a pressurized three dimensional region in proximity to a user;

an inflation system configured to actively transmit ambient air within the inflatable chamber with a fan thereby transitioning the inflatable chamber from the compressed state to the inflated state, and wherein the inflation system is further configured to actively transmit ambient air from the inflatable chamber external of the system with the fan thereby transitioning the inflatable chamber from the inflated state to the compressed state;

an activation system configured to activate the inflation system; and a harness configured to support the inflatable chamber, activation system, and inflation system in proximity to the user.

2. The system of claim 1, wherein the inflation system is configured to move the fan in two opposite directions corresponding to an inflation position and a deflation position respectively.

3. The system of claim 1, wherein inflation system further includes:

an air intake; and an internal airway channel coupled to both the air intake and the inflatable chamber, and wherein the fan is disposed with respect to the internal airway channel at a location substantially adjacent to the inflatable chamber.

4. The system of claim 3, wherein the internal airway channel further includes a valve internally disposed between the fan and the inflatable chamber, wherein the valve is configured to permit transmission within the internal airway channel oriented between the fan and the inflatable chamber and restrict transmission within the internal airway channel oriented between the inflatable chamber and the fan.

5. The system of claim 3, wherein the internal airway channel includes a housing fixably coupled substantially adjacent to the inflatable chamber, and wherein the fan is disposed within the housing.

6. The system of claim 1, wherein the system further includes:

an air intake;

an internal airway channel coupled to both the air intake and the inflatable chamber, and wherein the fan is disposed with respect to the internal airway channel at a location substantially adjacent to the inflatable chamber;

wherein the internal airway channel further includes a valve disposed between the fan and the inflatable chamber, wherein the valve is configured to permit transmission within the internal airway channel oriented between the fan and the inflatable chamber and restrict transmission within the internal airway channel oriented between the inflatable chamber and the fan; and wherein the fan is moveable within the internal airway channel between an inflation position and a deflation position.

7. The system of claim 6, wherein the moveable configuration of the fan includes a translational movement between the inflation position and the deflation position.

8. The system of claim 6, wherein the movement of the fan with respect to the internal airway channel is configured to automatically correspond to the rotational direction of the fan.

9. The system of claim 6, wherein the automatic correspondence of the fan movement with respect to the rotational direction of the fan includes translating the fan within the internal airway channel in response to the thrust force generated by the fan.

10. The system of claim 6, wherein the fan includes a supportive member and the internal airway channel includes a supportive slot, and wherein the supportive member of the fan is moveably coupled within the supportive slot of the internal channel between a inflation supportive position and a deflation supportive position, and wherein the inflation supportive position corresponds to the inflation position of the fan within the internal airway channel and the deflation supportive position corresponds to the deflation position of the fan within the internal airway channel.

11. The system of claim 6, wherein the fan includes a fan magnet and the internal airway channel includes a biasing magnet, and wherein the inflation position of the fan corresponds to an engagement of a releasable coupling between the fan magnet and the biasing magnet thereby biasing the position of the fan with respect to the internal airway channel.

12. The system of claim 6, wherein the fan includes a deflation member configured to open the valve in the deflation position.

13. The system of claim 12, wherein the deflation member is disposed and oriented on the fan to correspond to the position and orientation of the valve within the internal airway channel.

14. The system of claim 1, wherein the activation system is configured to automatically deflate the inflatable chamber subsequent to inflating the inflatable chamber after a particular period of time.

15. The system of claim 1, wherein the activation system is configured to automatically deflate the inflatable chamber subsequent to inflating the inflatable chamber based on an algorithm, wherein the algorithm includes at least one of receiving a user deflation action, a particular time after inflation of the inflatable chamber, a temperature, a pressure, and a gyroscopic position.

16. An inflatable avalanche safety system comprising:

an inflatable chamber including a compressed state and an inflated state, wherein the inflated state forms a pressurized three dimensional region in proximity to a user;

an inflation system configured to actively transmit ambient air within the inflatable chamber with a fan thereby transitioning the inflatable chamber from the compressed state to the inflated state, and wherein the inflation system is further configured to actively transmit ambient air from the inflatable chamber external of the system with the fan thereby transitioning the inflatable chamber from the inflated state to the compressed state;

an activation system configured to activate the inflation system;

a harness configured to support the inflatable chamber, activation system, and inflation system in proximity to the user;

an air intake;

an internal airway channel coupled to both the air intake and the inflatable chamber, and wherein the fan is disposed with respect to the internal airway channel at a location substantially adjacent to the inflatable chamber;

wherein the internal airway channel further includes a valve disposed between the fan and the inflatable chamber, wherein the valve is configured to permit transmission within the internal airway channel oriented between the fan and the inflatable chamber and restrict transmission within the internal airway channel oriented between the inflatable chamber and the fan;

wherein the fan is internally moveable within the internal airway channel between an inflation position and a deflation position; and wherein the movement of the fan with respect to the internal airway channel is configured to automatically correspond to the rotational direction of the fan.

17. The method of claim 16, wherein the act of automatically opening a channel between an internal region of the inflatable chamber and an external location further includes automatically moving the fan in response to a force generated by the fan rotation.

18. The method of claim 16, wherein the act of automatically opening a channel between an internal region of the inflatable chamber and an external location further includes automatically opening a valve in response to the force generated by the fan rotation.

19. The method of claim 16, wherein the act of automatically opening a channel between an internal region of the inflatable chamber and an external location further includes automatically translating the fan to a position that opens a valve in response to the force generated by the fan rotation.

20. A method for deflating an inflatable chamber comprising the acts of:

providing an inflatable avalanche safety system comprising:

an inflatable chamber including a compressed state and an inflated state, wherein the inflated state forms a pressurized three dimensional region in proximity to a user;

an inflation system configured to actively transmit ambient air within the inflatable chamber with a fan thereby transitioning the inflatable chamber from the compressed state to the inflated state, and wherein the inflation system is further configured to actively transmit ambient air from the inflatable chamber external of the system with the fan thereby transitioning the inflatable chamber from the inflated state to the compressed state;

an activation system configured to activate the inflation system; and a harness configured to support the inflatable chamber, activation system, and inflation system in proximity to the user;

rotating the fan in a rotational orientation opposite of an orientation that is configured to transmit ambient air within the inflatable chamber;

automatically opening a channel between an internal region of the inflatable chamber and an external location; and actively transmitting the ambient air from the inflatable chamber external of the system thereby transitioning the inflatable chamber from the inflated state to the compressed state.

21. An inflatable avalanche safety system comprising:

an inflatable chamber including a compressed state and an inflated state, wherein the inflated state forms a pressurized three dimensional region in proximity to a user;

an inflation system configured to transmit a gas within the inflatable chamber thereby transitioning the inflatable chamber from the compressed state to the inflated state, and wherein the inflation system is further configured to automatically transmit the gas from the inflatable chamber external of the system thereby transitioning the inflatable chamber from the inflated state to the compressed state, and wherein the inflation system is configured to automatically actively transmit the gas from the inflatable chamber external of the system with a fan;

an activation system configured to activate the inflation system; and a harness configured to support the inflatable chamber, activation system, and inflation system in proximity to the user.

22. The system of claim 21, wherein the inflation system is configured to transmit a gas into the inflatable chamber via a first channel, thereby transitioning the inflatable chamber from the compressed state to the inflated state, and wherein the inflation system is further configured to automatically transmit the gas out of the inflatable chamber external of the system via a second channel, thereby transitioning the inflatable chamber from the inflated state to the compressed state, and wherein the first and second channel are independent.

23. The system of claim 22, wherein the second channel includes a valve disposed on an external surface of the inflatable chamber.

24. The system of claim 21, wherein the inflation system is configured to transmit a gas into the inflatable chamber via a first channel, thereby transitioning the inflatable chamber from the compressed state to the inflated state, and wherein the inflation system is further configured to automatically transmit the gas out of the inflatable chamber external of the system via a second channel, thereby transitioning the inflatable chamber from the inflated state to the compressed state, and wherein the first and second channel both include an internal channel through the harness.

25. The system of claim 24, wherein the second channel includes a valve disposed on the harness.

* * * * *